US007637584B2

(12) United States Patent
Takata

(10) Patent No.: US 7,637,584 B2
(45) Date of Patent: Dec. 29, 2009

(54) IMAGE FORMING APPARATUS WITH REDUCED MOMENTARY CURRENT CONSUMPTION

(75) Inventor: Takuya Takata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 276 days.

(21) Appl. No.: 11/527,599

(22) Filed: Sep. 27, 2006

(65) Prior Publication Data

US 2007/0070102 A1 Mar. 29, 2007

(30) Foreign Application Priority Data

Sep. 27, 2005 (JP) ..... 2005-280658

(51) Int. Cl.
*B41J 29/38* (2006.01)
*B41J 29/393* (2006.01)

(52) U.S. Cl. ..... 347/12; 347/11; 347/19

(58) Field of Classification Search ..... 347/11
See application file for complete search history.

(56) References Cited

U.S. PATENT DOCUMENTS 5,669,720 A * 9/1997 Negishi et al. ..... 400/120.05
6,296,341 B1 * 10/2001 Sugahara ..... 347/14
6,315,379 B1 * 11/2001 Adams et al. ..... 347/14
6,533,379 B1 * 3/2003 Kubota ..... 347/12
6,614,554 B1 * 9/2003 Yokoi ..... 347/11
7,441,853 B2 * 10/2008 Takata ..... 347/14
2005/0073537 A1 4/2005 Iwao
2006/0055717 A1 * 3/2006 Hirota ..... 347/12
2006/0071980 A1 * 4/2006 Usui ..... 347/57
2006/0187250 A1 * 8/2006 Takata ..... 347/10

FOREIGN PATENT DOCUMENTS

JP 2005-59440 A 3/2005

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

An image forming apparatus with reduced momentary current consumption is provided. The apparatus includes: a plurality of drive waveform generating circuits; a circuit selection device which selectively switches the drive waveform generating circuits for applying the drive signal waveforms to pressure generating elements; a power source which supplies power to the pressure generating elements via the drive waveform generating circuits; and a control device which selects a first drive waveform generating circuit used for driving each of the pressure generating elements, with respect to each of the pressure generating elements, of the plurality of drive waveform generating circuits, in such a manner that no drive waveform generating circuit in which an amount of momentary current consumption exceeds a prescribed tolerable value, of the plurality of drive waveform generating circuits, exists.

12 Claims, 20 Drawing Sheets

IMAGE FORMING APPARATUS WITH REDUCED MOMENTARY CURRENT CONSUMPTION

BACKGROUND OF THE INVENTION

1. Field of the Invention

The present invention relates to an image forming apparatus, and more particularly, to an image forming apparatus which carries out printing by using a liquid ejection head having pressure generating elements corresponding to a plurality of nozzles.

2. Description of the Related Art

In general, in an inkjet type recording apparatus (inkjet printer), ink droplets are ejected at prescribed timings, respectively, from the nozzles of the recording head, on the basis of the dot pattern data (also called "dot data" or "print data") developed from image data for printing which has been input from a host computer, and printing is carried out by means of these respective ink droplets landing on and adhering to a recording medium, such as recording paper.

As a method of the recording head, for example, a method is known which ejects ink droplets by causing a change in the volume of pressure chambers (pressure generating chambers) connected to nozzles. In a recording head of this kind, a diaphragm which is elastically deformable in the outward direction is formed on a portion of the circumferential walls which demarcate the pressure chambers, and the volume of the pressure chambers is changed by causing this diaphragm to vibrate by means of pressure generating elements which are represented by piezoelectric elements.

Usually, a plurality of nozzles are formed in a recording head, and a pressure chamber and a piezoelectric element are provided for each nozzle. All of the piezoelectric elements are electrically connected in parallel between a common power supply and ground wire, and a switching element is electrically connected in series to each of the piezoelectric elements. Signals (drive waveform) for driving the piezoelectric elements are generated by a drive waveform generating circuit, and they are distributed and supplied selectively to the piezoelectric elements via power supply lines and switching elements. More specifically, when a prescribed switching element is selected and switched on, on the basis of the print data, then a drive waveform is applied to the piezoelectric element, via a power supply line, and an ink droplet is ejected from a prescribed nozzle corresponding to the piezoelectric element to which the drive waveform has been applied.

In an inkjet recording apparatus which uses piezoelectric elements as described above, generally, a common drive circuit system is adopted, which uses one common drive waveform that combines a plurality of drive waveform elements for ejecting a plurality of types of ink droplets of different ink volumes (for example, a large dots, a medium dot, and a small dot), the required waveform portion being applied selectively to each of the piezoelectric elements, by means of switching elements. This system has benefits in that, since a common drive waveform is applied simultaneously to a plurality of piezoelectric elements, there is no need to prepare drive waveform generating circuits individually for each of the piezoelectric elements, and therefore the number of high-voltage high-precision analogue circuits, and the number of wires, can be reduced.

On the other hand, in recent years, with the object of increasing printing speed, and the like, printers based on a line head system (or array system) have been proposed, in which a very large number of nozzles are prepared, ink being ejected simultaneously from a large number of nozzles in such a manner that printing is carried out at high speed. If the common drive circuit system described above is applied directly to a line type of recording head having a plurality of nozzles, then the load of each drive circuit is high, and therefore the drive waveform is distorted. Consequently, not only does ink ejection become instable, but also, the current passing through all of the piezoelectric elements exceeds the drive capability of the drive circuits, and the heat generated by this may possibly lead to break down of the circuits.

One technique for resolving a problem of this kind is a method which drives the ejection of the piezoelectric elements at staggered timings. However, there is a problem with this method in that it impairs the high-speed printing capability which is a characteristic feature of a line type of recording head.

As a further possible solution, Japanese Patent Application Publication No. 2005-59440 discloses a method (circuit division method) which divides a very large number of piezoelectric elements into a plurality of groups and then drives the piezoelectric elements by means of drive circuits which are separated according to the groups in such a manner that the drive circuits respectively drives the groups. According to this method, the load is divided between a plurality of drive circuits, and the required current and heat generation in each drive circuit is reduced. Therefore, the high-speed characteristics of the line head system can be utilized. However, although the composition described above is extremely beneficial with respect to the drive capacity, heat generation and power consumption of the drive circuits, it has the following problems. More specifically, in a line head system in which a plurality of nozzles are arranged in an array configuration, it is necessary to drive ejection of ink from a very large number of nozzles, simultaneously, and therefore, the momentary current consumption of the print system as a whole may become problematic, depending on the timing of the drive waveforms generated by the plurality of drive circuits. When a plurality of piezoelectric elements are driven simultaneously, a current flows momentarily, and therefore it is necessary to prepare a drive circuit having a high drive capacity, or an appropriate number of drive circuits, in order to handle a large current. In addition to this, excess capacity is required in the power source which supplies power to the drive circuits, and it is difficult to supply the power from a wall socket or distribution panel. Furthermore, even supposing that an extremely large power source can be prepared so that the prescribed power can be supplied to the drive circuits, not only does the output voltage of the actual power source fall momentarily as a result of the momentary current, but also, a voltage drop is caused by a pattern in the power lines from the power source to the piezoelectric elements, impedances of wiring such as FPCs, or the electronic components such as transistors and resistances. Therefore, the voltage of the drive waveform ultimately applied to the piezoelectric elements falls, and it becomes difficult to eject ink appropriately. Therefore, image quality is degraded.

A method for improving the aforementioned circuit division method is known, in which the momentary current and the momentary power are restricted by controlling the timings of the drive waveforms (in other words, the phases of the drive waveforms) from a plurality of drive circuits. However, it is difficult to restrict the momentary current simply by staggering the phases of the drive waveforms, and furthermore, the time taken for printing is lengthened in accordance with the amount by which the phases are staggered. Therefore, the high printing speed which is characteristic of a line head system is impaired. Moreover, displacement of the deposition positions (landing positions) of the ink droplets may occur, and this may be visible as displacement of the pixels.

Furthermore, in a recording head, there is some, albeit slight, variation in the nozzle shapes, and this may give rise to variation in the deposition positions of the ink droplets. In particular, in a recording head having a plurality of nozzles, such as a line head, variation in the deposition positions caused by variation in the nozzle shapes is unavoidable, and there is a high possibility that this leads to be visible in the form of non-uniformities in the image.

SUMMARY OF THE INVENTION

The present invention is contrived in view of the foregoing circumstances, and object thereof being to provide an image forming apparatus which is capable of high-quality image recording, irrespectively of the presence or absence of variation in the deposition positions.

In order to attain the aforementioned object, the present invention is directed to an image forming apparatus, comprising: a liquid ejection head including a plurality of nozzles arranged in a prescribed pattern in a first direction and a plurality of pressure generating elements provided to correspond with the plurality of nozzles respectively, wherein liquid is ejected toward a recording medium from the nozzles by supplying drive signals to the pressure generating elements; a plurality of drive waveform generating circuits which generate drive signal waveforms for driving the pressure generating elements; a circuit selection device which selectively switches the drive waveform generating circuits for applying the drive signal waveforms to the pressure generating elements, of the plurality of drive waveform generating circuits; a power source which supplies power to the pressure generating elements via the drive waveform generating circuits; and a control device which selects a first drive waveform generating circuit used for driving each of the pressure generating elements, with respect to each of the pressure generating elements, of the plurality of drive waveform generating circuits, in such a manner that the liquid ejected from the nozzles is deposited substantially linearly in the first direction on the recording medium, and controls the circuit selection device in such a manner that the first drive waveform generating circuit is connected to each of the pressure generating elements.

According to this aspect of the present invention, even if there is variation in the deposition positions of the liquid ejected from the nozzles, since the positions of the liquid droplets ejected from the liquid ejection head can be controlled by selecting the drive waveform generating circuits for each of the pressure generating elements in such a manner that recording can be performed in a substantially linear fashion in the first direction, then it is possible to record an image of high quality. Furthermore, the tolerances in the arrangement and formation precision of nozzles can be increased.

The present invention is suitable for a line head in which a plurality of nozzles are formed through a length corresponding to the breadthways dimension of the recording medium, but it may also be applied to a shuttle head which performs recording by scanning in the breadthways direction of the recording medium. In the case of a line head, the "first direction" corresponds to the breadthways direction of the recording medium, and in the case of a shuttle head, the "first direction" corresponds to the paper conveyance direction, which is perpendicular to the breadthways direction of the recording medium.

Preferably, the control device selects a second drive waveform generating circuit which is different from the first drive waveform generating circuit, instead of the first drive waveform generating circuit, of the plurality of drive waveform generating circuits, in respect of at least a portion of the pressure generating elements, in such a manner that no drive waveform generating circuit in which an amount of momentary current consumption exceeds a prescribed tolerable value, of the plurality of drive waveform generating circuits, exists.

According to this aspect of the present invention, it is possible to reduce the momentary power consumption in each of the drive waveform generating circuits.

The "prescribed tolerable value" is set on the basis of the drive capacity of the drive waveform generating circuits, for example. This "prescribed tolerable value" may be set individually in respect of each one of the plurality of drive waveform generating circuits, but if using a plurality of drive waveform generating circuits having substantially the same drive capacity, then it is desirable to set a "prescribed tolerable value" which can be used commonly for the circuits.

Preferably, of the drive signal waveforms generated by the drive waveform generating circuits, the drive signal waveform generated by the second drive waveform generating circuit has less phase difference with respect to the drive signal waveform generated by the first drive waveform generating circuit.

According to this aspect of the present invention, it is possible to reduce the momentary power consumption of each of the drive waveform generating circuits, and to minimize the variation in the deposition positions.

Preferably, the plurality of nozzles include a first nozzle and a second nozzle which have an offset in a second direction perpendicular to the first direction, the offset being smaller than a dot pitch in the second direction between dots formed by the liquid ejected from the nozzles.

According to this aspect of the present invention, the apparatus can be made more compact.

Preferably, the control device selects the second drive waveform generating circuit, giving priority to the pressure generating element which corresponds to the nozzle in a side end section of the liquid ejection head, rather than the nozzle in a central portion of the liquid ejection head, of the plurality of pressure generating elements.

According to this aspect of the present invention, it is possible to reduce the momentary power consumption, and to reduce the visibility of non-uniformities caused by variation in the liquid deposition positions.

Preferably, a phase of the drive signal waveform generated by the first drive waveform generating circuit coincides with a phase of the drive signal waveform generated by the second drive waveform generating circuit.

Preferably, the image forming apparatus further comprises a spare drive waveform generating circuit, wherein the control device selects the spare drive waveform generating circuit in a case where an amount of momentary current consumption of the first drive waveform generating circuit exceeds a prescribed tolerable value.

Preferably, the control device controls a phase of the drive signal waveform generated by at least one of the plurality of drive waveform generating circuits, in such a manner that an amount of momentary current consumption of the power source is not more than a prescribed upper limit value.

According to this aspect of the present invention, it is possible to reduce the momentary power consumption of the power source. The "prescribed tolerable value" is set on the basis of the capacity of the power source and the drive capacity of each of the drive waveform generating circuits, for example.

Preferably, the plurality of nozzles form a plurality of nozzle rows which are each arranged in an oblique direction which is not perpendicular to the first direction.

As described above, the present invention is suitable for a head in which a plurality of nozzles are arranged at high density in a two-dimensional configuration.

Preferably, the liquid ejection head includes a plurality of short heads arranged in the first direction; and the control device controls the circuit selection device, in such a manner that the liquid ejected from the nozzles in each of the short heads is deposited substantially linearly in the first direction on the recording medium and the liquid ejected from the nozzles in the short heads adjacent to each other is deposited substantially linearly in the first direction on the recording medium.

According to this aspect of the present invention, it is possible to correct variation in a deposition position with respect to each short head, and to correct variation in a deposition position caused by connection errors between the short heads.

Preferably, the liquid ejection head includes a plurality of short heads arranged in the first direction; and the control device controls the circuit selection device in such a manner that the liquid ejected from the nozzles in each of the short heads is deposited substantially linearly in the first direction on the recording medium and the liquid ejected from the nozzles in the short heads adjacent to each other is deposited substantially linearly in the first direction on the recording medium, and selects the second drive waveform generating circuit, giving priority to the pressure generating elements in the short head arranged in a side end section of the short heads, in such a manner that an amount of momentary current consumption of the first drive waveform generating circuit does not exceed a prescribed tolerable value.

Preferably, the control device selects the second drive waveform generating circuit, giving priority to the pressure generating element which corresponds to the nozzle that is distant from an end section of the short head arranged in the side end section where another short head of the short heads is disposed, of the nozzles of the short head arranged in the side end section.

According to the present invention, even if there is variation in the deposition positions of the liquid ejected from the nozzles, since the positions of the liquid droplets ejected from the liquid ejection head can be controlled by selecting the drive waveform generating circuits for each of the pressure generating elements in such a manner that recording can be performed in a substantially linear fashion in the first direction, then it is possible to record an image of high quality. Furthermore, the tolerances in the arrangement and formation precision of nozzles can be increased.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

General Composition of Inkjet Recording Apparatus

Figure 1:
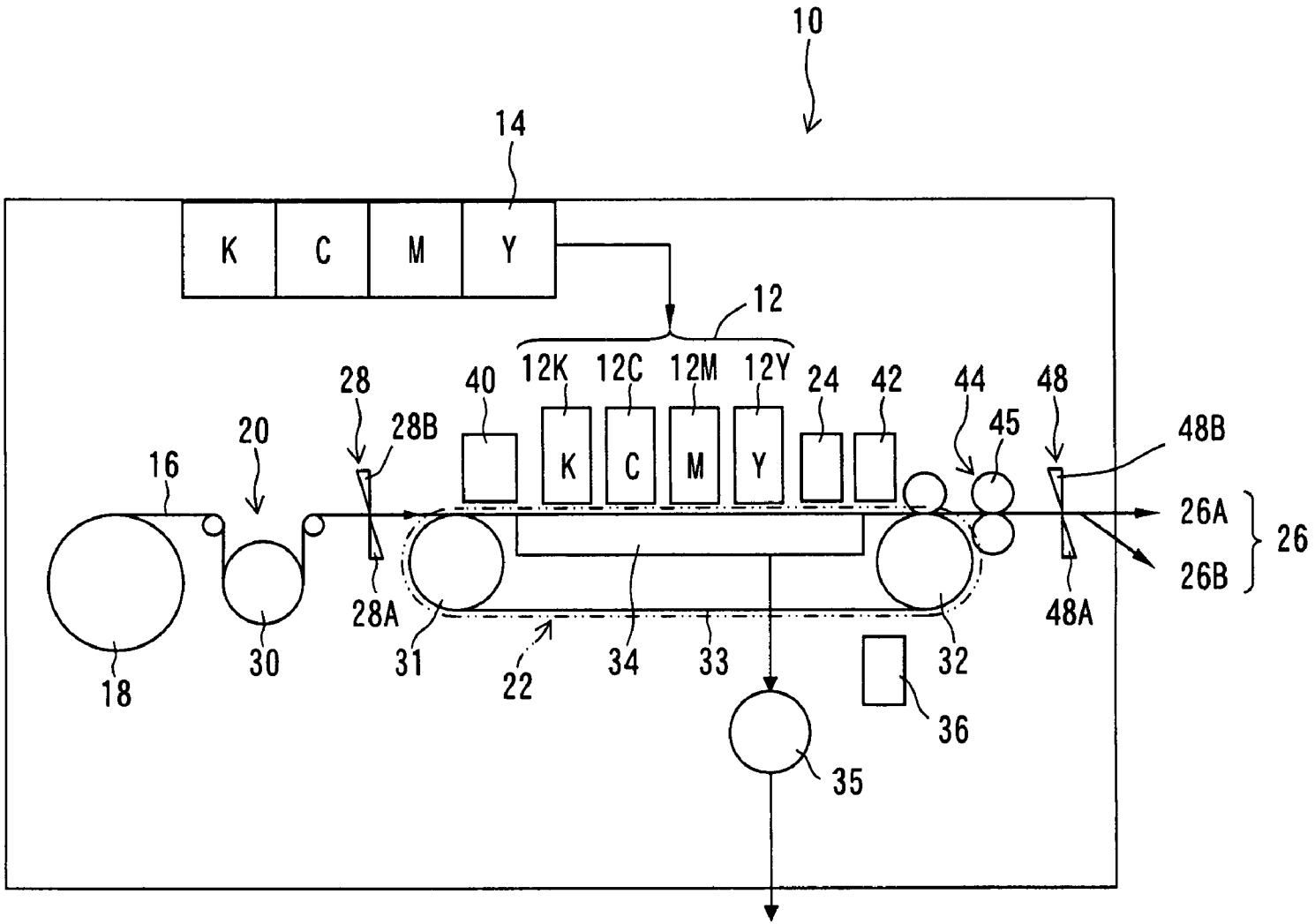
FIG. 1 is a general schematic drawing of an inkjet recording apparatus relating to an embodiment of the present invention.

FIG. 1 is a general configuration diagram of an inkjet recording apparatus according to an embodiment of the present invention. As shown in FIG. 1, the inkjet recording apparatus 10 comprises: a printing unit 12 having a plurality of inkjet heads (hereinafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying a piece of recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M, and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The cut recording paper 16 that is decurled is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed before the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
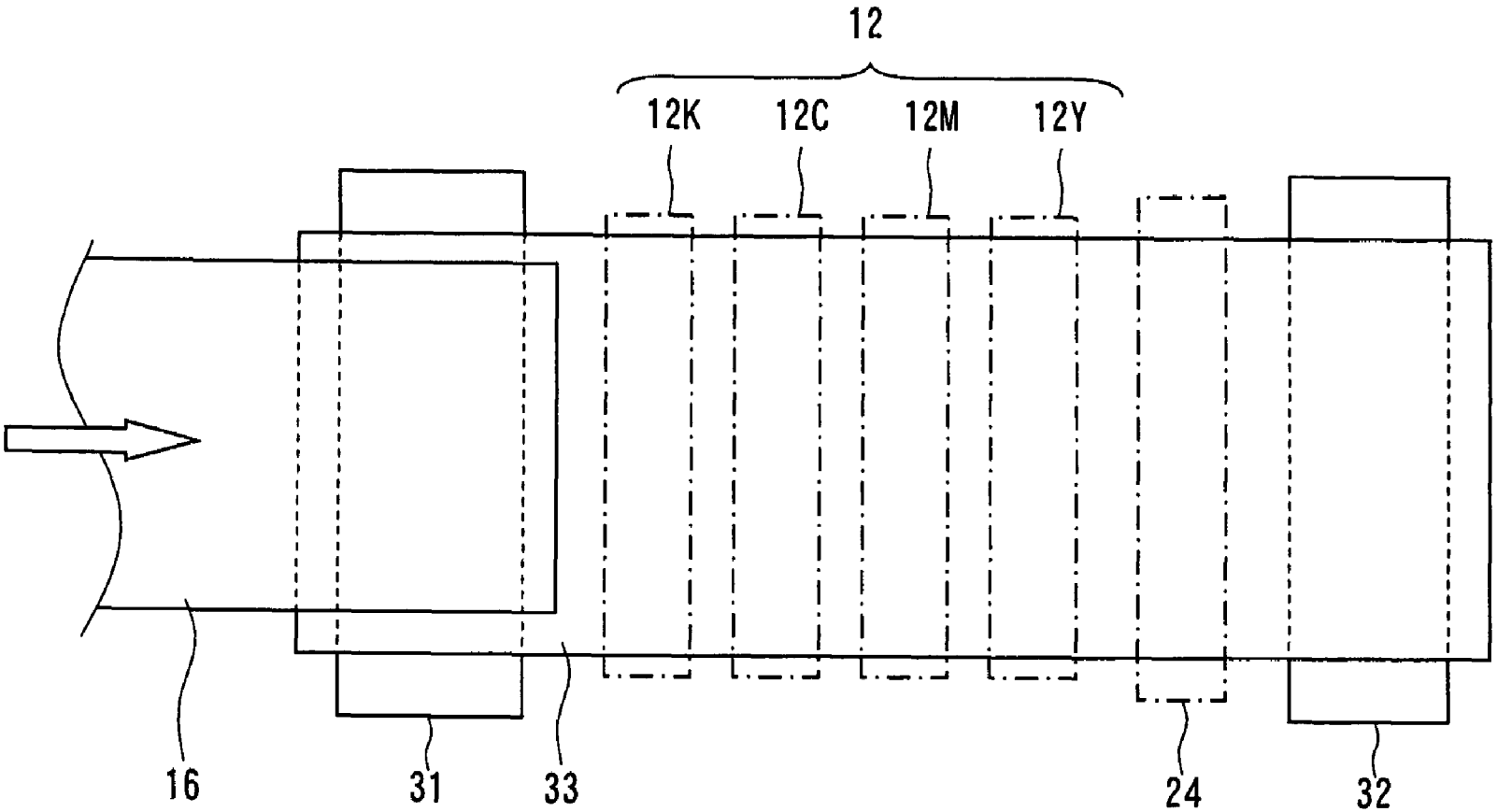
FIG. 2 is a principal plan diagram of the peripheral area of a print unit in the inkjet recording apparatus illustrated in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M, and 12Y, while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions on the sequence in which the heads of respective colors are arranged.

The print determination unit 24 shown in FIG. 1 has an image sensor for capturing an image of the ink-droplet deposition result by the printing unit 12, and functions as a device to check for ejection defects such as a blockage in the nozzles in the printing unit 12 on the basis of the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row with an R filter including photoelectric transducing elements (pixels) arranged in a line provided, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matters with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a head is described below. The heads 12K, 12C, 12M and 12Y of the respective ink colors have the same structure, and a reference numeral 50 is hereinafter designated to any of the heads.

Figure 3:
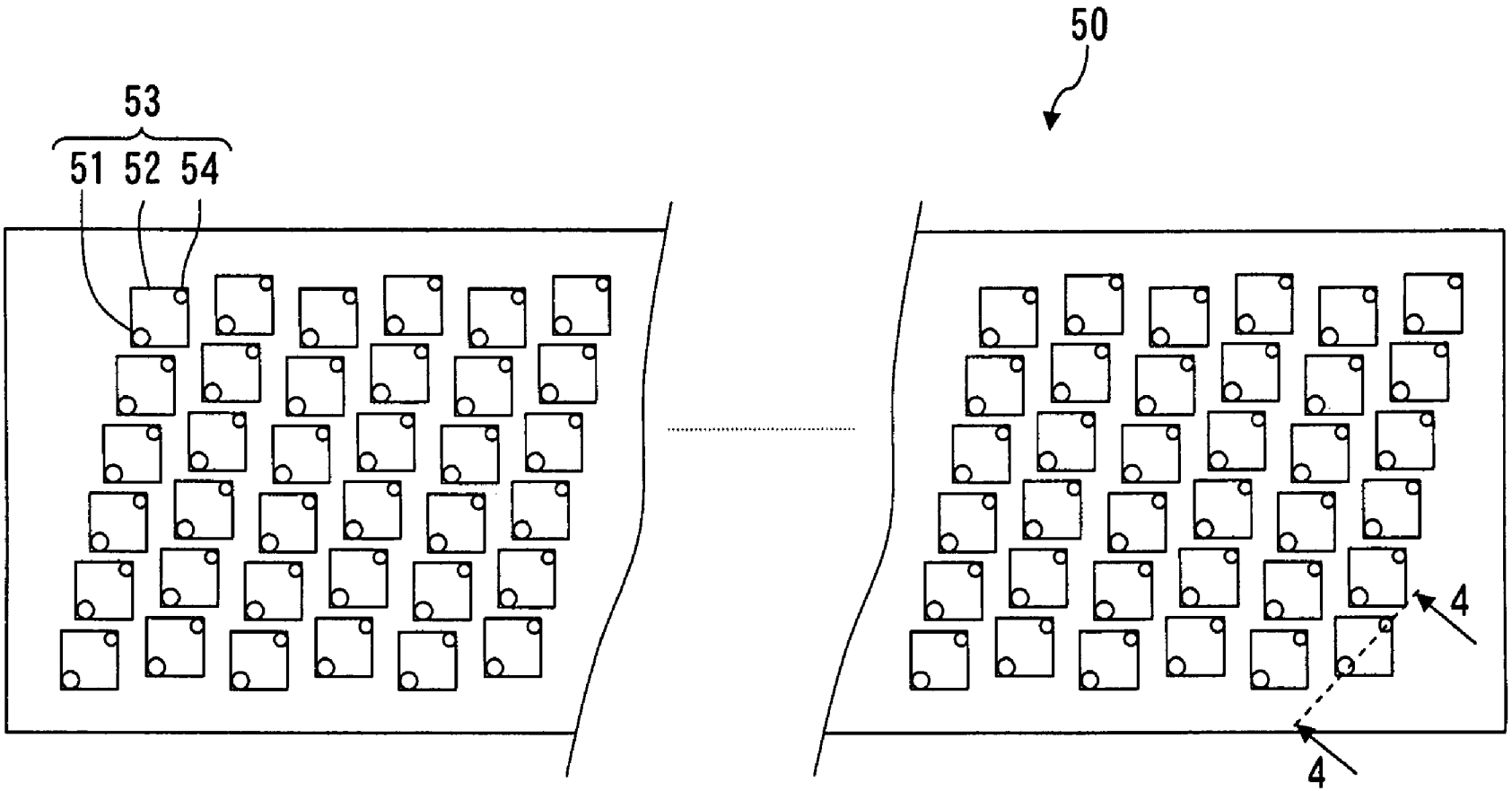
FIG. 3 is a plan view perspective diagram showing an embodiment of the composition of a print head.

FIG. 3 is a plan view perspective diagram showing an embodiment of the structure of a head 50. Furthermore, FIG. 4 is a cross-sectional view along line 4-4 in FIG. 3.

The nozzle pitch in the head 50 is required to be minimized in order to maximize the density of the dots printed on the surface of the recording paper 16. As shown in FIG. 3, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

As shown in FIG. 3, the planar shape of the pressure chamber 52 provided for each nozzle 51 is substantially a square, and an outlet to the nozzle 51 and an inlet of supplied ink (supply port) 54 are disposed in both comers on a diagonal line of the square.

Figure 4:
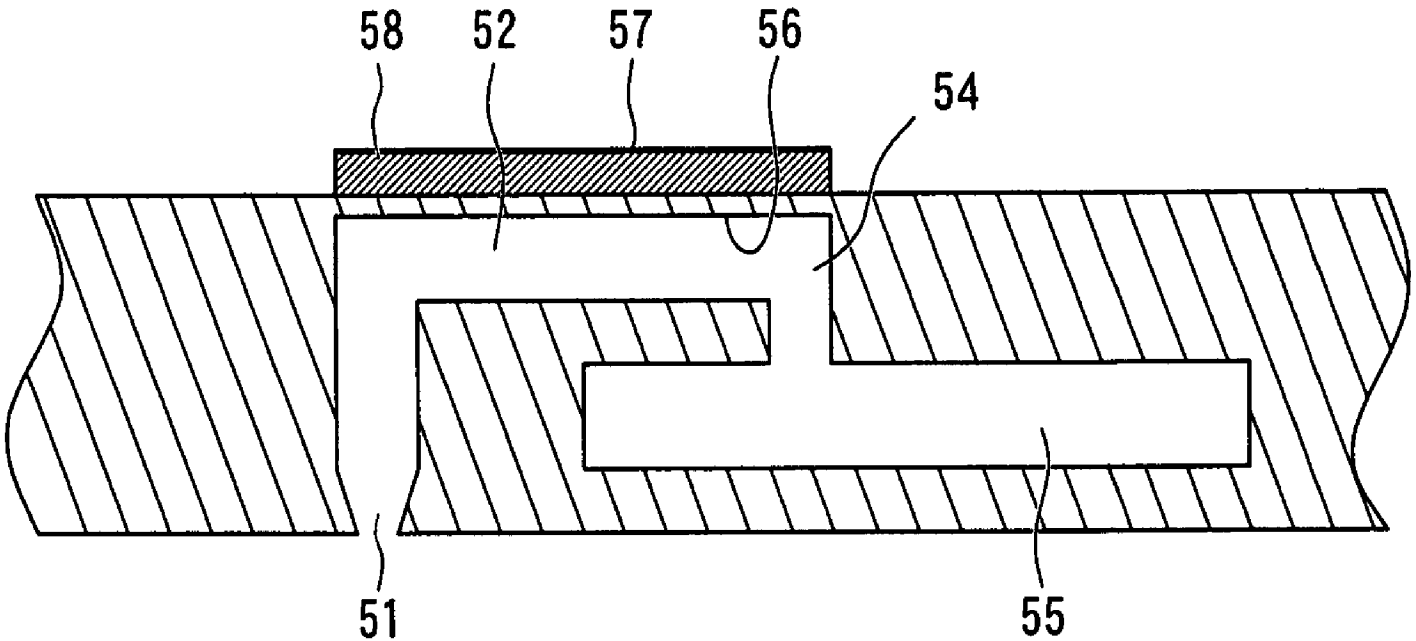
FIG. 4 is a cross-sectional view along line 4-4 in FIG. 3.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 (equivalent to pressure generation elements) provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
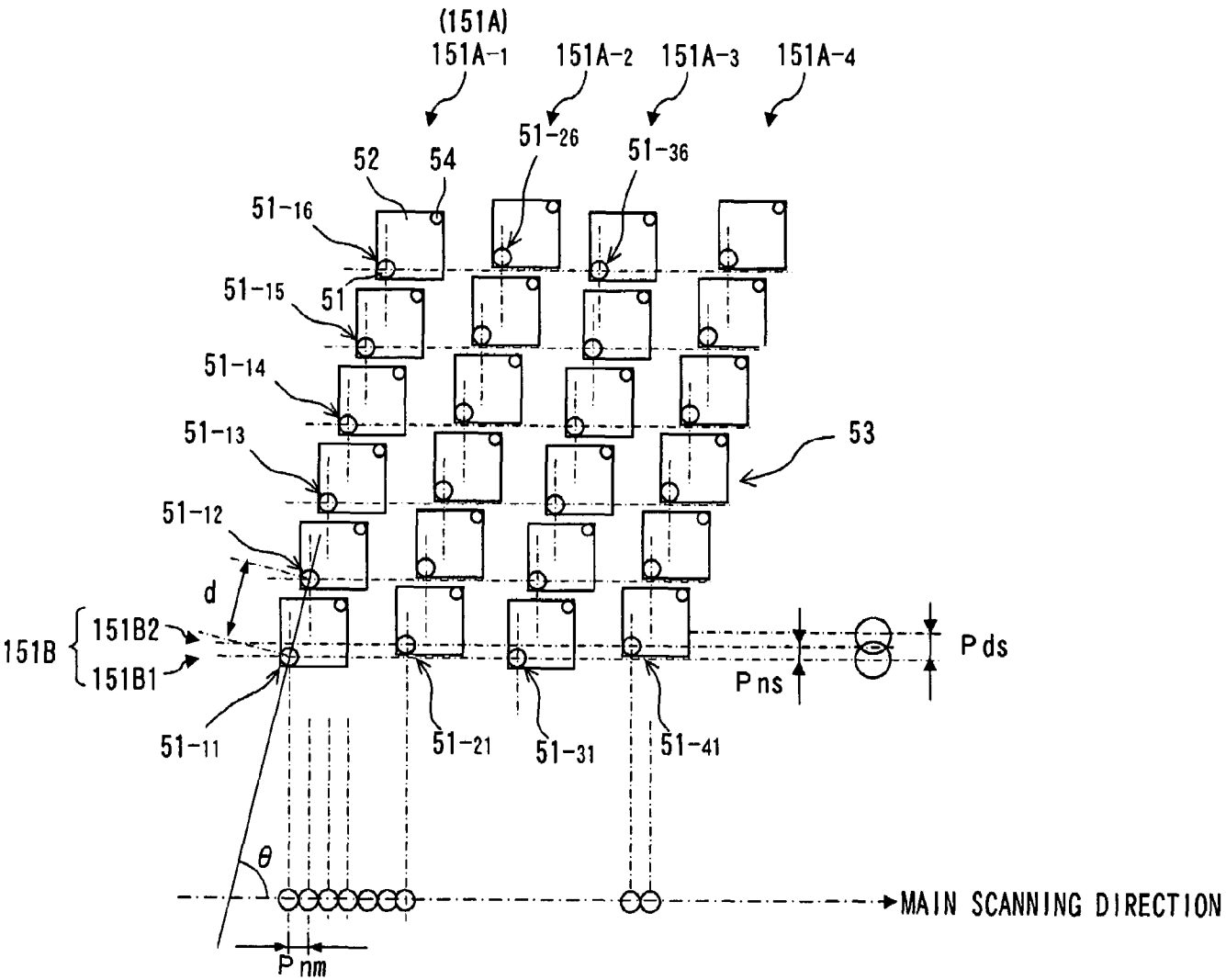
FIG. 5 is an enlarged view showing a nozzle arrangement in the print head illustrated in FIG. 3.

FIG. 5 is an enlarged view showing an embodiment of the nozzle arrangement in the head 50 shown in FIG. 3. As shown in FIG. 5, in the head 50 of the present embodiment, a high-density nozzle head is achieved by arranging a plurality of ink chamber units 53 comprising nozzles 51 in a lattice configuration according to a fixed arrangement pattern following the main scanning direction, and an oblique direction having a fixed non-perpendicular angle of $\theta$ with respect to the main scanning direction.

More specifically, by adopting a structure in which a plurality of ink chamber units 53 are arranged at a uniform pitch d in line with a direction forming an angle of $\theta$ with respect to the main scanning direction, the pitch of the nozzles (nozzle pitch) projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch (2,400 nozzles/inch), for example.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

Here, if the nozzles 51 (for example, 51-11, 51-21, 51-31, 51-41) are arranged in a linear fashion following the main scanning direction, then when one line is printed in the main scanning direction, the nozzles are driven simultaneously, and there is a problem in that the momentary power consumption of the drive circuit increases. This kind of problem is particularly marked in a line head formed to a high density, as in the present embodiment. Therefore, according to the present embodiment, the following nozzle arrangement is adopted in order to reduce the momentary power consumption.

In FIG. 5, of the nozzle columns 151A arranged following a direction at an angle of θ with respect to the main scanning direction (namely, 151A-1, 151A-2, 151A-3, 151A-4), the nozzle columns 151A-2 and 151A-4 are offset by Pns in the sub-scanning direction, with respect to the other nozzle columns 151A-1 and 151A-3. For reference, the dots formed by droplets ejected from a particular nozzle (for example, nozzle 51-11) are depicted on the right-hand side of FIG. 5, where Pds represents the dot pitch in the sub-scanning direction. As FIG. 5 reveals, a composition is adopted where the offset amount Pns of the nozzle columns 151A-2 and 151A-4 in the sub-scanning direction is smaller than the dot pitch Pds in the sub-scanning direction. In other words, the offset amount of the nozzle columns 151A-2 and 151A-4 in the sub-scanning direction is within the range of one pixel.

Stated alternatively, nozzles that are mutually adjacent in the main scanning direction in the nozzle row 151B, which is arranged in a fixed pattern in the main scanning direction, for example, nozzle 51-21 and nozzle 51-11 (or 51-31), are separated by a nozzle pitch of Pns (<Pds) in the sub-scanning direction. Moreover, to describe the composition in yet another fashion, the nozzle row 151B constituted by the nozzles 51-11, 51-21, 51-31, 51-41 has a split composition in which it is divided into two rows, namely, a first nozzle row 151B1 comprising the nozzles 51-11 and 51-31 which are arranged in linear fashion in the main scanning direction, and a second nozzle row 151B2 comprising the nozzles 51-21 and 51-41 which are arranged in linear fashion in the main scanning direction. The pitch in the sub-scanning direction between the first nozzle row 151B1 and the second nozzle row 151B2 is Pns (<Pds).

The concrete control method used in the nozzle arrangement composition of this kind is described in detail below, by when one line is printed in the main scanning direction, it is possible to drive the nozzle row 151B1 and the nozzle row 151B2 at different drive timings, and therefore, compared to a case where the nozzle row 151B is arranged in a linear fashion in the main scanning direction, the number of nozzles (and hence the number of actuators) that are required to be driven simultaneously is halved (reduced by half). Consequently, the momentary power consumption of the drive circuit is halved (reduced by half).

In particular, by adopting a composition in which the nozzle row 151B is constituted by a plurality of rows, within the range of one pixel, as described above, more precise control of the drive timing (in other words, phase control) can be carried out, and hence it is possible to correct variation in the deposition positions, and to reduce the momentary power consumption, in an effective manner, while it is possible to maintain the high-speed printing capability that is characteristic of a line head system. Furthermore, the head can also be made more compact.

In the present embodiment, a mode is shown in which the nozzle row 151B is divided into two rows within the range of one pixel, but the invention is not limited to this, and it is also possible to adopt a split composition in which the nozzle row is divided into three or more rows within the range of one pixel. For example, compared to a one-row composition, the momentary power consumption is reduced to ⅓ in the case of a three-row composition, and it is reduced to ¼ in the case of a four-row composition. Here, the momentary power consumption can be reduced significantly by increasing the number of rows, but there is also a possibility that increasing complexity of the nozzle arrangement may lead to decline in the nozzle processing accuracy, increase in the scale of the circuitry, and lengthening of the drive cycle (ejection cycle). Therefore, it is desirable to keep the number of rows as small as possible, and a two-row composition as in the present embodiment is more desirable.

Furthermore, in the present embodiment, the nozzle pitch in the sub-scanning direction between nozzles of the nozzle row 151B which are mutually adjacent in the main scanning direction, for examples, between nozzles 51-11 and 51-21, is Pns. In other words, nozzles which are mutually adjacent in the main scanning direction are not driven at the same drive timing, and therefore, cross talk between adjacent nozzles is prevented. Furthermore, the power consumption is also distributed.

In the present embodiment, a method is employed in which an ink droplet is ejected by means of the deformation of an actuator 58, which is represented by a piezoelectric element. However, in implementing the present invention, the method used for ejecting ink is not limited in particular, and instead of a piezo system, it is also possible to apply various types of systems, such as a thermal system where the ink is heated and bubbles are caused to form therein by means of a heat generating body such as a heater, ink droplets being ejected by means of the pressure created by these bubbles.

Configuration of a Ink Supply System

Figure 6:
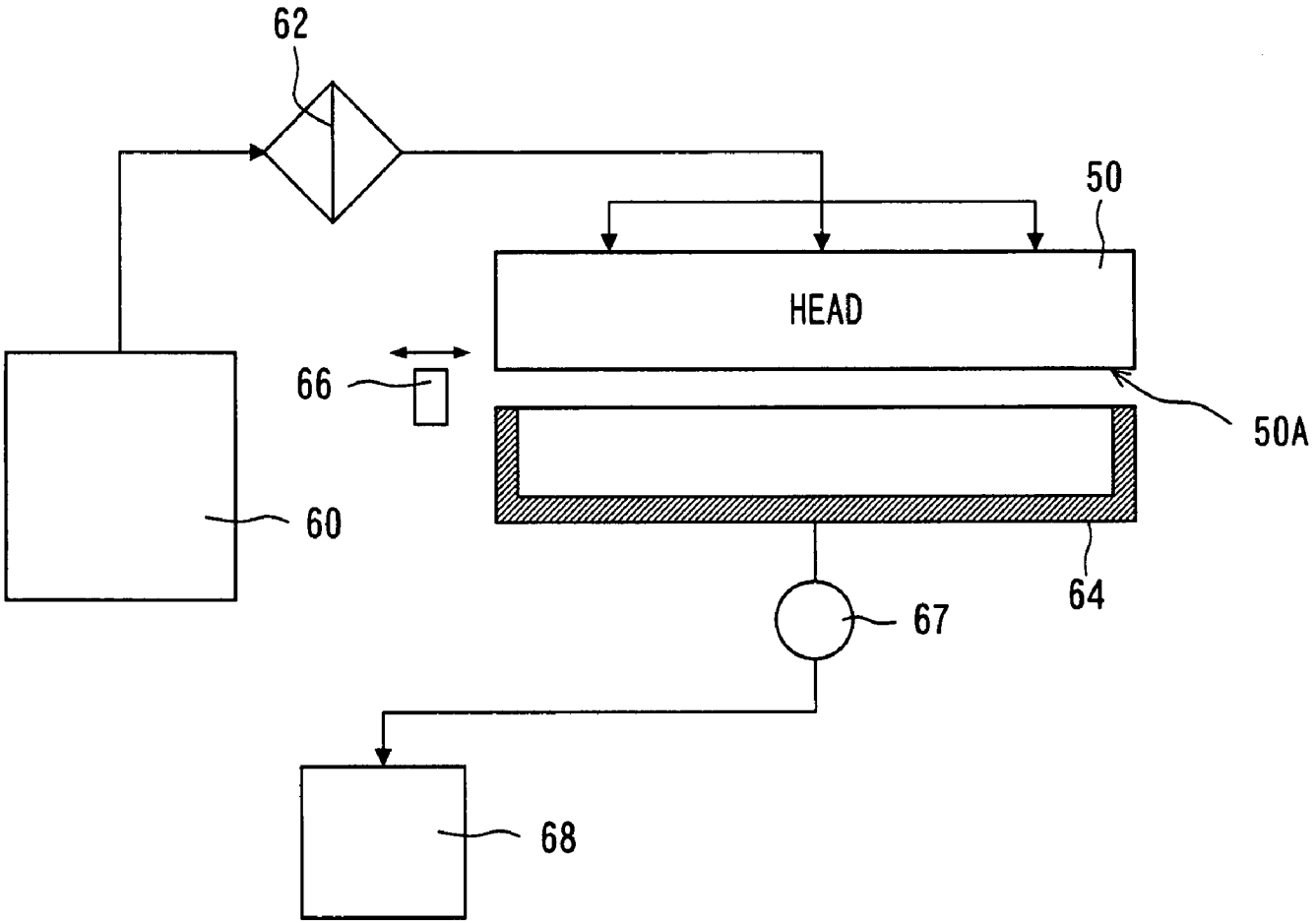
FIG. 6 is a schematic drawing showing the composition of an ink supply system.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the "preliminary discharge" to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, or when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred embodiment is one in which a preliminary discharge is performed when the increase in the viscosity of the ink is small.

Description of Control System

Figure 7:
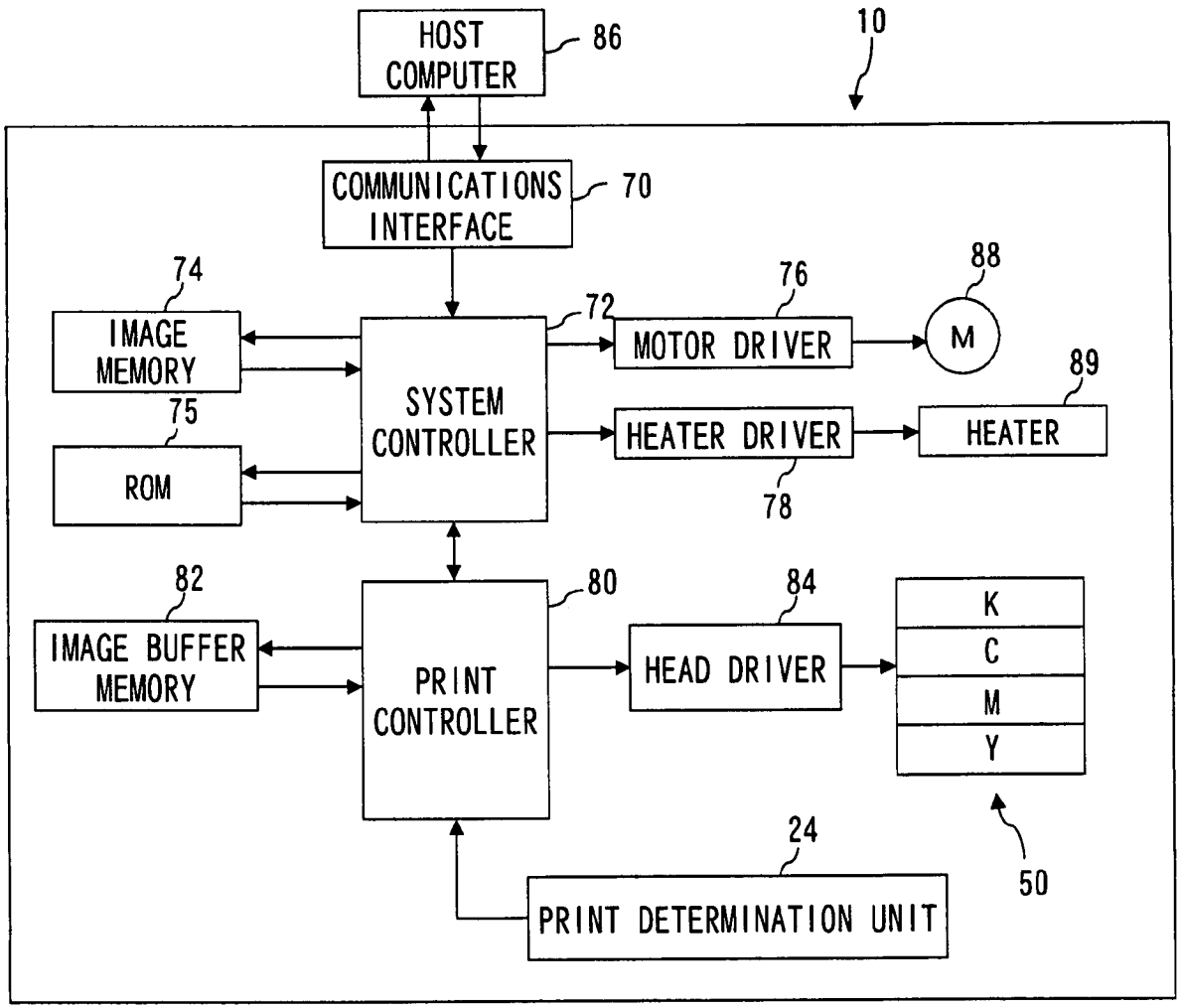
FIG. 7 is a principal block diagram showing a system composition.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface or a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the heads of the respective colors 12K, 12C, 12M and 12Y on the basis of dot data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by a known dithering algorithm, an error diffusion method, or another technique in the print controller 80. In other words, the print controller 80 performs processing for converting the input RGB image data into dot data for four colors, KCMY. The dot data generated by the print controller 80 is stored in the image buffer memory 82.

The head driver 84 outputs signals for driving the actuators 58 of the head 50, on the basis of the dot data stored in the image buffer memory 82, and ink is ejected from the head 50 by applying the drive signals output by the head driver 84 to the head 50. By controlling ink ejection from the heads 50 in synchronization with the conveyance speed of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

Figure 8:
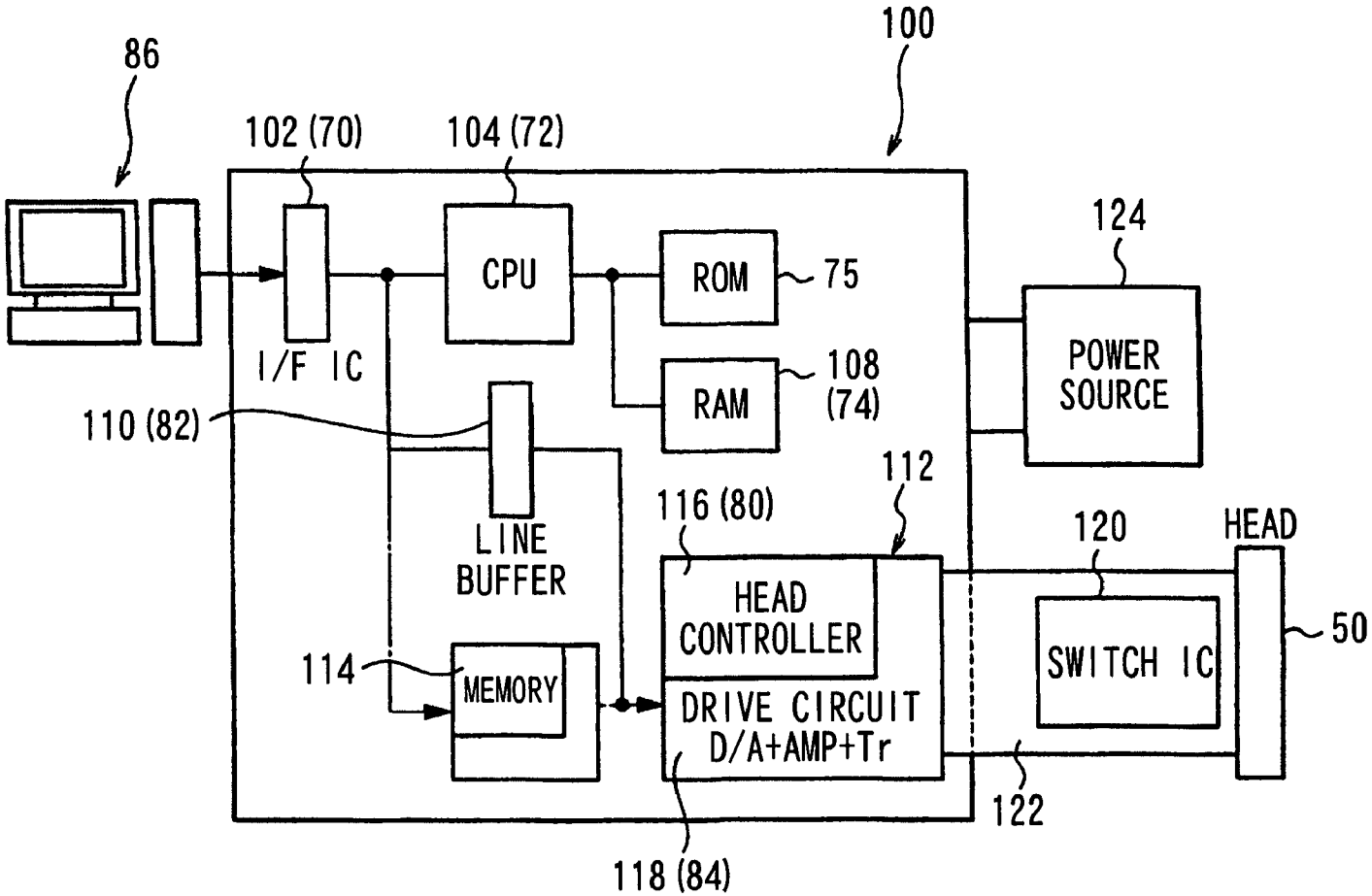
FIG. 8 is a principal schematic drawing of the main circuits relating to head driving.

Next, a drive method of the print head 50 in the inkjet recording apparatus 10 according to the present embodiment is described below. FIG. 8 is a principal compositional diagram of the main circuitry relating to head driving of an inkjet recording apparatus 10. A communications interface IC 102, CPU 104, ROM 75, RAM 108, line buffer 110 and driver IC 112 are installed on a circuit substrate 100 mounted on an inkjet recording apparatus 10.

The communications interface IC 102 corresponds to the communications interface indicated by reference numeral 70 in FIG. 7. The CPU 104 in FIG. 8 functions as the system controller 72 shown in FIG. 7. The RAM 108 in FIG. 8 functions as the image memory 74 as described in FIG. 7, and the line buffer 110 in FIG. 8 functions as the image buffer memory 82 shown in FIG. 7. It is also possible to provide a memory 114, instead of or in conjunction with the line buffer 110. The memory 114 can also serves as a portion of the RAM 108.

The details of the driver IC 112 shown in FIG. 8 are described later in relation to FIG. 9, but the driver IC 112 includes a head controller 116 (corresponding to the print controller 80 described in FIG. 7) and a drive circuit element 118 including a D/A converter, amplifier, transistor, and the like (corresponding to the head driver 84 shown in FIG. 7). The driver IC 112 shown in FIG. 8 is connected electrically to a print head 50 via a wiring member 122 provided with a switch IC 120 (for example, a wiring member which combines a flexible cable and a rigid substrate).

The switch IC 120 includes a serial/parallel (S/P) conversion circuit and a switch element array. Furthermore, the power supply circuit 124 is connected to this circuit substrate 100, in such a manner that electrical power is supplied to the circuit blocks from the power supply circuit 124.

Figure 9:
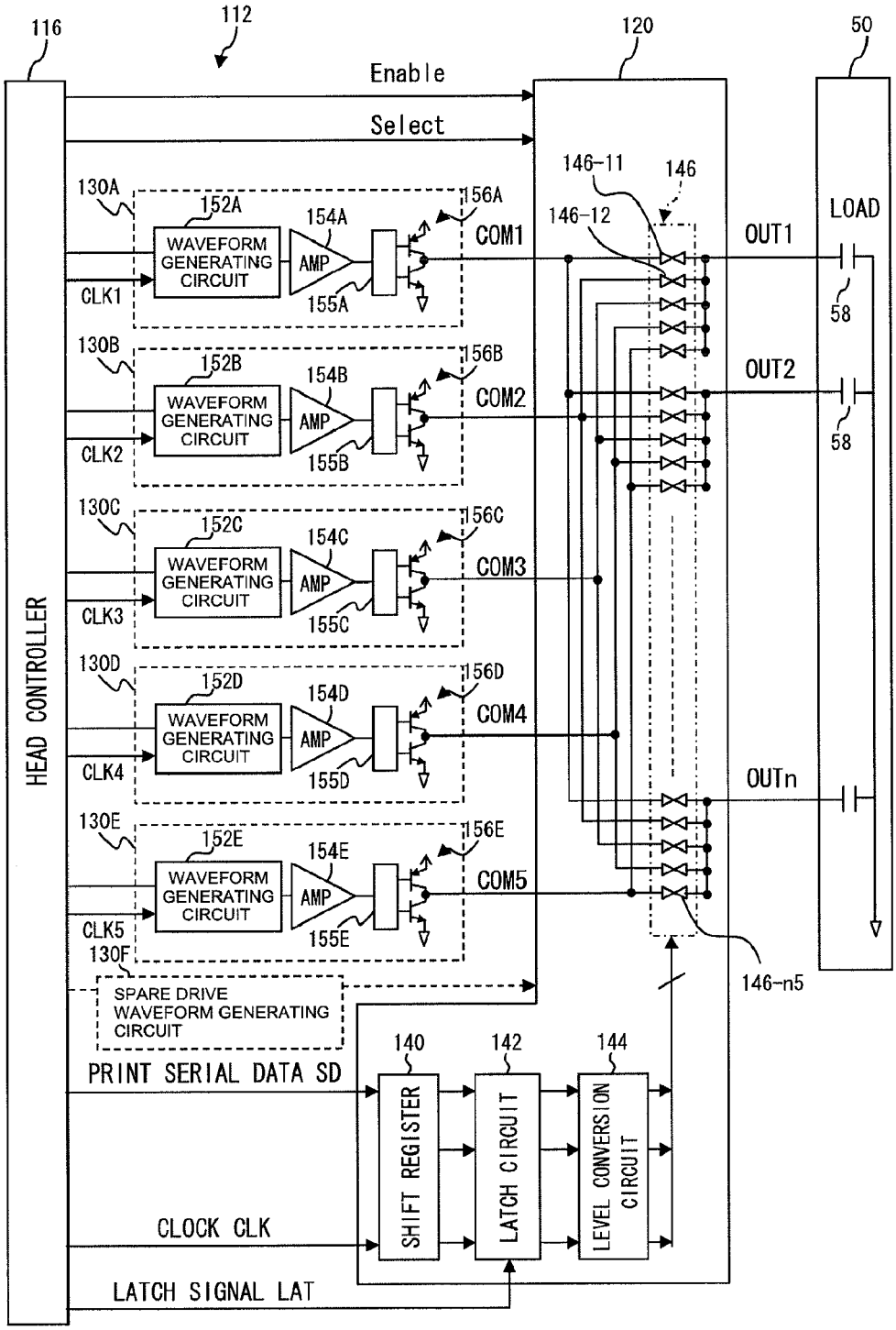
FIG. 9 is a principal schematic drawing of a driver IC and a switch IC.

FIG. 9 is a principal compositional diagram of a driver IC 112 and switch IC 120 including a head controller 116. As shown in FIG. 9, the driver IC 112 chiefly comprises: a head controller 116, a first drive waveform generating circuit 130A, a second drive waveform generating circuit 130B, a third drive wire generating circuit 130C, a fourth drive waveform generating circuit 130D and a fifth drive waveform generating circuit 130E.

Furthermore, as shown in FIG. 9, the switch IC 120 comprises a shift register 140, a latch circuit 142, a level conversion circuit 144, and a switching element array 146, and it functions as a selection circuit for applying the drive waveforms from the drive waveform generating circuits 130A to 130E, selectively, to the actuators 58 of the head 50. In FIG. 9, the elements indicated as capacitive loads together with the reference numerals OUT1, OUT2, . . . , OUTn, are the actuators (piezoelectric elements) 58 of the print head 50. Each of the individual electrodes 57 of the actuators 58 (the electrodes on the left-hand side in the capacitive loads shown in FIG. 9) is connected to a terminal of the corresponding switching elements 146-ij (i=1, 2, . . . n; j=1, 2, 3, 4, 5), and the other electrode (common electrode) of each actuator 58 is connected to ground (GND).

In the present embodiment, the switch IC 120 functions as a "circuit selection device", and the head controller 116 functions as a "control device".

The drive waveform generating circuits 130A to 130E include waveform generating circuits 152A to 152E containing D/A converters (DAC) for converting the digital waveform data output from the head controller 116 into an analog signal according to the clock signals CLK1 to CLK5; amplifier circuits 154A to 154E for amplifying the drive waveforms in accordance with the output level of the waveform generating circuits 152A to 152E; charging and discharging circuits 155A to 155E; and push-pull circuits 156A to 156E. In other words, the digital waveform data relating to an ejection drive waveform output from the head controller 116 is input to the waveform generating circuits 152A to 152E, and converted into an analog signal corresponding to the input waveform data, at the waveform generating circuits 152A to 152E. This analog waveform signal is amplified to a prescribed level by the amplifier circuit 154A to 154E, the power of the signal is amplified by the push-pull circuit 156A to 156E, and the signal is then output as a drive signal waveform. The common drive waveforms generated in this way are input to the corresponding ports "COM1" to "COM5" of the switch IC 120. In other words, the inkjet recording apparatus 10 according to the present example includes five independent drive circuits indicated by the reference numerals 130A to 130E.

The switch IC 120 is a circuit (multiplexer) which selectively switches the connection relationship between the "ports COM1 to COM5" and "the actuators 58 (OUT1, . . . , OUTn) according to the control signals supplied from the head controller 116.

As shown in the diagram, the "COM1" port is connected to the input side terminals of the switching elements 146-i1 (i=1, 2, . . . , n) and the input side terminals of the switching elements 146-bi1 (i=1, 2, . . . , m). Similar to the COM1 port, the "COM2" port is connected to the input side terminals of the switching elements 146-i2 (i=1, 2, . . . , n), the "COM3" port is connected to the input side terminals of the switching elements 146-i3 (i=1, 2, . . . , n), the "COM4" port is connected to the input side terminals of the switching elements 146-i4 (i=1, 2, . . . , n), and the "COM5" port is connected to the input side terminals of the switching elements 146-i5 (i=1, 2, . . . , n). The actuators (piezoelectric elements) 58 in "OUTi" (i=1, 2, . . . , n) are connected to the output side terminals of the switching elements 146-i1 to 146-i5 (i=1, 2, . . . , n), and are composed in such a manner that a drive signal can be selectively applied to the actuators (OUTi) by controlling the on/off switching of the switching elements 146-i1 to 146-i5. In other words, looking at one actuator 58 (or a nozzle 51 corresponding to one actuator 58), a composition is achieved in which one drive circuit can be selected for that actuator, from among the five drive waveform generating circuits 130A to 130E, in accordance with the circumstances.

As described above, the head controller 116 shown in FIG. 9 supplies digital waveform data and clock signals (CLK1 to CLK5) to the drive waveform generating circuits 130A to 130E, and supplies control signals ("Enable", "Select", and the like) for the switch IC 120. Furthermore, the head controller 116 generates print data developed into a dot pattern on the basis of the image information supplied from the host computer 86 (see FIG. 8), and also generates a latch signal (LAT) for controlling the serial transmission clock signal (CLK) and the latch timing. In tune with the clock signal CLK, the print data generated by the head controller 116 in FIG. 9, and the clock signal CLK, are sent (by serial transmission) to the shift register 140 as print serial data SD. The print data stored in the shift register 140 is latched by the latch circuit 142 on the basis of the latch signal LAT output from the head controller 116.

The signal latched by the latch circuit 142 is converted to a prescribed voltage value in the level conversion circuit 144, the prescribed voltage value being determined so that the switching elements 146-ij (i=1, 2, . . . , n; j=1, 2, 3, 4) can be driven. The on/off switchings of the switching elements 146-ij (i=1, 2, . . . , n; j=1, 2, 3, 4) are controlled according to the output signals from the level conversion circuit 144.

Figure 10A:
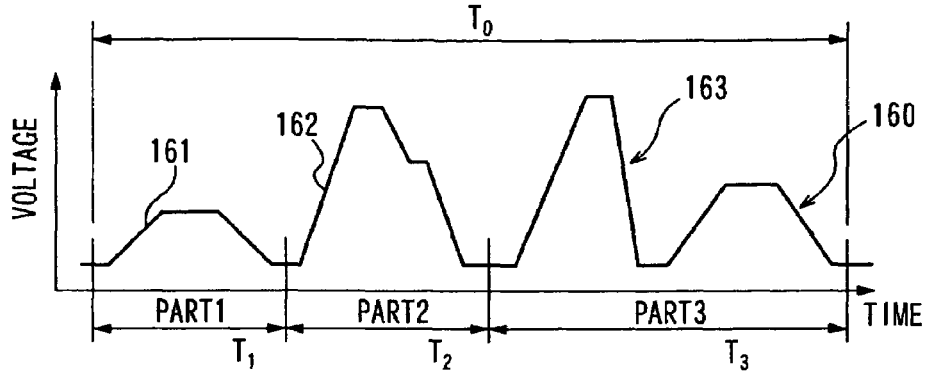
FIGS. 10A to 10E are waveform diagrams showing embodiments of common drive waveforms.

FIG. 10A is a waveform diagram showing one embodiment of a common drive waveform output from the drive waveform generating circuits 130A to 130E. As shown in FIG. 10A, the common drive waveform 160 comprises, linked in a continuous fashion: a slight vibration waveform component 161 (the "part 1" pulse section in FIG. 10A) which causes the meniscus to vibrate while restricting the energy to a level at which ink is not ejected; a first ejection waveform component 162 (the "part 2" pulse section in FIG. 10A) for ejecting a liquid droplet for a small dot (for example, 3 pl); and a second ejection waveform component 163 (the "part 3" pulse section in FIG. 10A) for ejecting a liquid droplet for a medium dot (for example, 6 pl). A waveform combining these three waveform components 161 to 163 is repeated at a prescribed cycle T0.

By controlling the switch-on and switch-off of the switching elements 146-ij (i=1, 2, . . . , n; j=1, 2, 3, 4, 5) shown in FIG. 9, it is possible to apply the slight vibration waveform component 161, the first ejection waveform component 162 or the second ejection waveform component 163, selectively, from the common drive waveform 160 shown in FIG. 10A, to the actuators 58 corresponding to the nozzles 51.

Figure 10B:
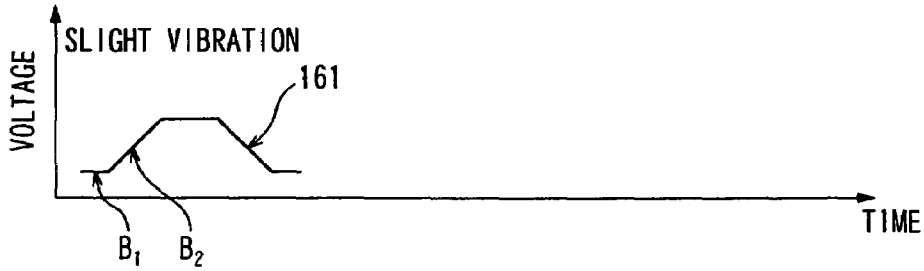

The slight vibration waveform component 161 shown in FIG. 10B has a waveform of small amplitude (voltage), compared to the other ejection waveform components (162 and 163). When this slight vibration waveform component 161 is applied to an actuator 58, the meniscus performs a slight vibration (of a degree which does not cause ejection), and hence rise in the viscosity of the ink is suppressed.

Figure 10C:
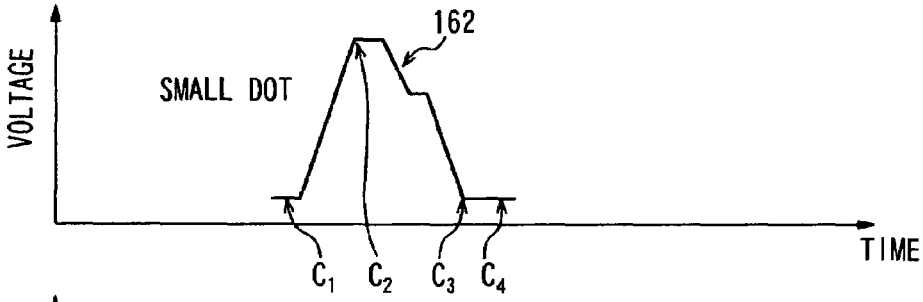
Figure 10D:
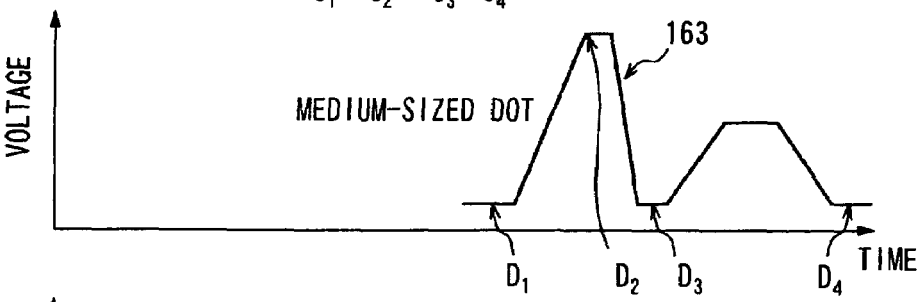

If the first ejection waveform component 162 shown in FIG. 10C is applied to an actuator 58, then a liquid droplet according to a small dot is ejected. If only the second ejection waveform component 163 shown in FIG. 10D is applied to an actuator 58, then a liquid droplet according to a medium dot is ejected. Furthermore, as shown in FIG. 10E, when the first ejection waveform component 162 and the second ejection waveform component 163 are applied consecutively to an actuator 58, then a liquid droplet for a large dot (for example, 9 pl) is ejected.

Figure 10E:
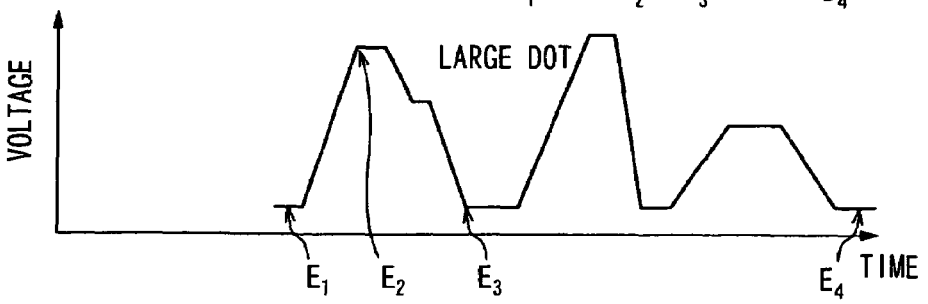

As shown in FIGS. 10C to 10E, the application timing (ejection timing) of the drive waveform varies within the drive waveform cycle T0, in accordance with the volume of the liquid droplet to be ejected; however, the difference in deposition positions between a small dot and a medium dot due to this time difference falls within a range which can be regarded as substantially the same image pixel on the recording medium.

In the embodiment shown in the drawings, the waveform interval T1 of the slight vibration waveform component 161, the waveform interval T2 of the first ejection waveform component 162, and the waveform interval T3 of the second ejection waveform component 163 have the relationship: T1=T2=T3/2; however, in implementing the present invention, the relationship between the waveform intervals of the waveform components is not limited to this embodiment. In control terms, it is desirable to set the waveform interval T1 of the slight vibration waveform component 161 to 1/N of the drive waveform cycle T0 (where N is a positive integer), since this facilitates the control of the application timing of the slight vibration waveform.

In the waveform diagrams shown in FIGS. 10B and 10E, if the characters "B" to "E" are represented by "n" (where n=B, C, D, E) in the sections B1 to B2, C1 to C4, D1 to D4 and E1 to E4, then "n1" corresponds to the stasis of meniscus, "n2" corresponds to pulling the meniscus, "n3" corresponds to pushing the meniscus (in other words, ejection), and "n4" corresponds to a state of preparation for the next ejection.

The nozzles which are to perform ejection and the nozzles which are not to perform ejection are determined on the basis of the print data, and one of the ejection waveform components shown in FIGS. 10C to 10E is applied to a nozzle which is to perform printing. Furthermore, the slight vibration waveform component shown in FIG. 10B is applied at a suitable timing to all or a portion of the nozzles which are not to perform printing.

Generally, when a piezoelectric element is driven, the drive current flowing in the piezoelectric element is charged and discharged according to the rise and fall periods of the drive waveform. In other words, a large drive current flows during the short time period where the drive waveform has a gradient, but during the rest of the time, hardly any current flows. Therefore, although the average current consumption is dependent on the conditions of the drive waveform and the drive frequency, it is equal to or less than 1/10 of the momentary current.

Under general ejection drive conditions for an inkjet printer using a piezoelectric element, the drive current I flowing in a piezoelectric element is given by the following expression, taking the capacitance C of one piezoelectric element to be "C=1 nF", and supposing that a voltage of 0V to 40V in the drive waveform is applied for approximately t=4 μs (slew rate 10 V/μs), $$\begin{aligned} I &= C \times V / t \\ &= 1(\text{nF}) \times 40(V) / 4(\mu s) \\ &= 10(\text{mA}). \end{aligned}$$

From the formula given above, it can be seen that the greater the slew rate (the steeper the gradient of the waveform), the greater the drive current I. Therefore, if the time period of the gradients is substantially uniform, as in the case of ON/OFF driving, then the higher the voltage, the greater the drive current.

Supposing that only one piezoelectric element is being driven, the drive current is not that large; however, in a line head system having a plurality of piezoelectric elements arranged in an array configuration, it is necessary to supply an extremely large drive current in order to drive a very large number of piezoelectric elements simultaneously.

Supposing that 1000 (=M) piezoelectric elements (nozzles) are to be simultaneously driven for ejection, then according to the calculation formula given above, the following expression is obtained:

$$\begin{aligned} I &= (C \times V / t) \times M \\ &= (1(\text{nF}) \times 40(V) / 4(\mu s)) \times 1000 \\ &= 10(A), \end{aligned}$$

and hence a drive current of 10A flows instantaneously for a period of 4 μs.

As shown in FIG. 9, as a result of distributing the load between circuits by using a plurality of drive waveform generating circuits 130A to 130E, it is possible to lower the drive current flowing through each drive waveform generating circuit 130A to 130E. However, at the power source, the drive capacity is required to be increased in accordance with the momentary current, which means that the scale of the power source becomes larger, which leads to increased costs and may give rise to situations where actually becomes impossible to create a printing system.

Furthermore, even supposing that an extremely large power source can be prepared, not only does the output voltage of the actual power source fall momentarily as a result of the momentary current, but also a voltage drop is caused by the patterns located in the power lines (power supply lines) from the power source to the piezoelectric elements, the impedances of wiring such as flexible printed circuits (FPCs), the electronic components such as transistors and resistances. Therefore, the voltage of the drive waveform ultimately applied to the piezoelectric elements falls, and there is a possibility that it may be impossible to eject ink appropriately.

Consequently, in the present embodiment, a function is provided for controlling the phase of the plurality of common drive waveforms generated by the plurality of drive waveform generating circuits 130A to 130E. More specifically, it is possible to easily stagger the digital waveform data input to the D/A converters (waveform generating circuits 152A to 152E) which generate the waveforms, by means of clocks. In other words, it is possible to alter the phase between waveforms, by suitable adjustment of the timings of the clocks CLK1 to CLK5.

Of course the method of staggering the phases of the plurality of common drive waveforms is not limited to the method described above, and it is also possible to generate waveforms having different phases by changing the digital waveform data while a common clock is used.

Figures 11A, 11B, 11C:
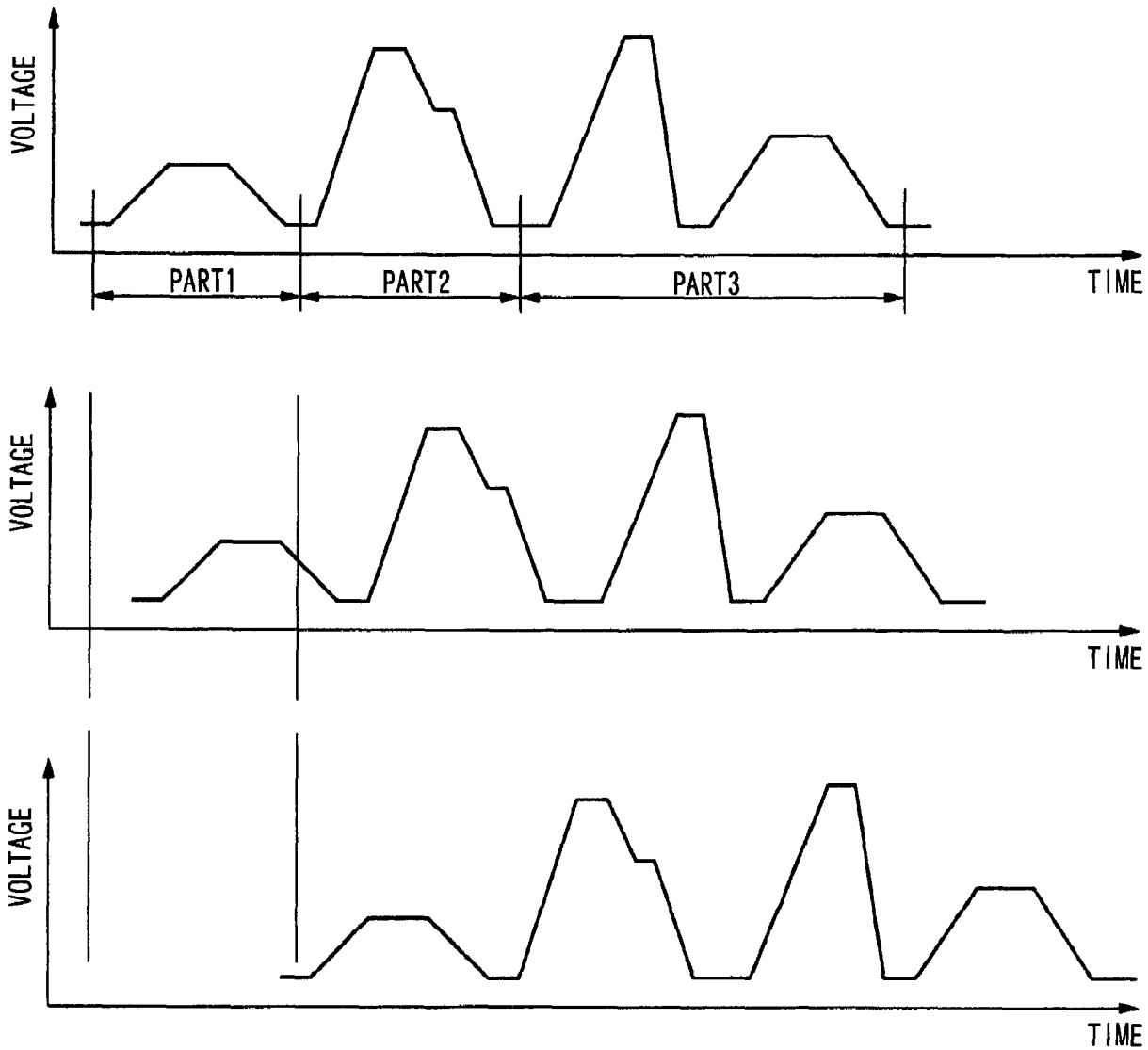
FIGS. 11A to 11C are waveform diagrams showing embodiments of methods of staggering a phase between a plurality of common drive waveforms.

FIGS. 11A to 11C show embodiments of a staggering method in which the phases are staggered between a plurality of common drive waveforms. FIG. 11A shows a common drive waveform forming a reference (called "reference waveform"). FIG. 11B shows a first waveform embodiment in which the phase is staggered with respect to the reference waveform in FIG. 11A, and FIG. 11C shows a second waveform embodiment.

In the embodiment in FIG. 11B, the phase is adjusted in such a manner that the gradient sections (rise and fall sections) of the common drive waveforms do not overlap with each other, as far as possible. If the gradient sections do overlap, then it is desirable that, as far as possible, sections of gentle gradient are selected. In this way, the momentary current is distributed over time, and the maximum momentary current experienced by the power source is effectively restricted.

In a case of common drive waveforms output from a plurality of drive waveform generating circuits 130A to 130E, it is possible to adjust the phases in advance as shown in FIGS. 11A and 11B, and it is also possible to adjust the phases as circumstances require, on the basis of the image data.

In other words, since information on the nozzles that are to eject ink and information on the ejection volume of each nozzle are ascertained by processing the image data, the drive waveforms that need to be applied to the piezoelectric elements in order to perform ejection can also be identified. Moreover, since the required amount of current is calculated from the drive waveforms, then it is possible to adjust the phases appropriately on the basis of these calculation results. For example, a drive waveform for ejecting a large ink volume also consumes a large amount of current, and therefore, if a large volume of ink is to be ejected simultaneously, then it is beneficial for the drive circuits and the power source if ejection is carried out by staggering the phase in use of a plurality of common drive waveforms.

FIG. 11C is an embodiment in which the phase is staggered in waveform component units, with respect to the reference waveform in FIG. 11A.

As shown in FIGS. 11A to 11C, desirably, the amount by which the phase of the plurality of common drive waveforms is staggered is made as short as possible, in order to achieve a high-speed printing operation.

Figure 12:
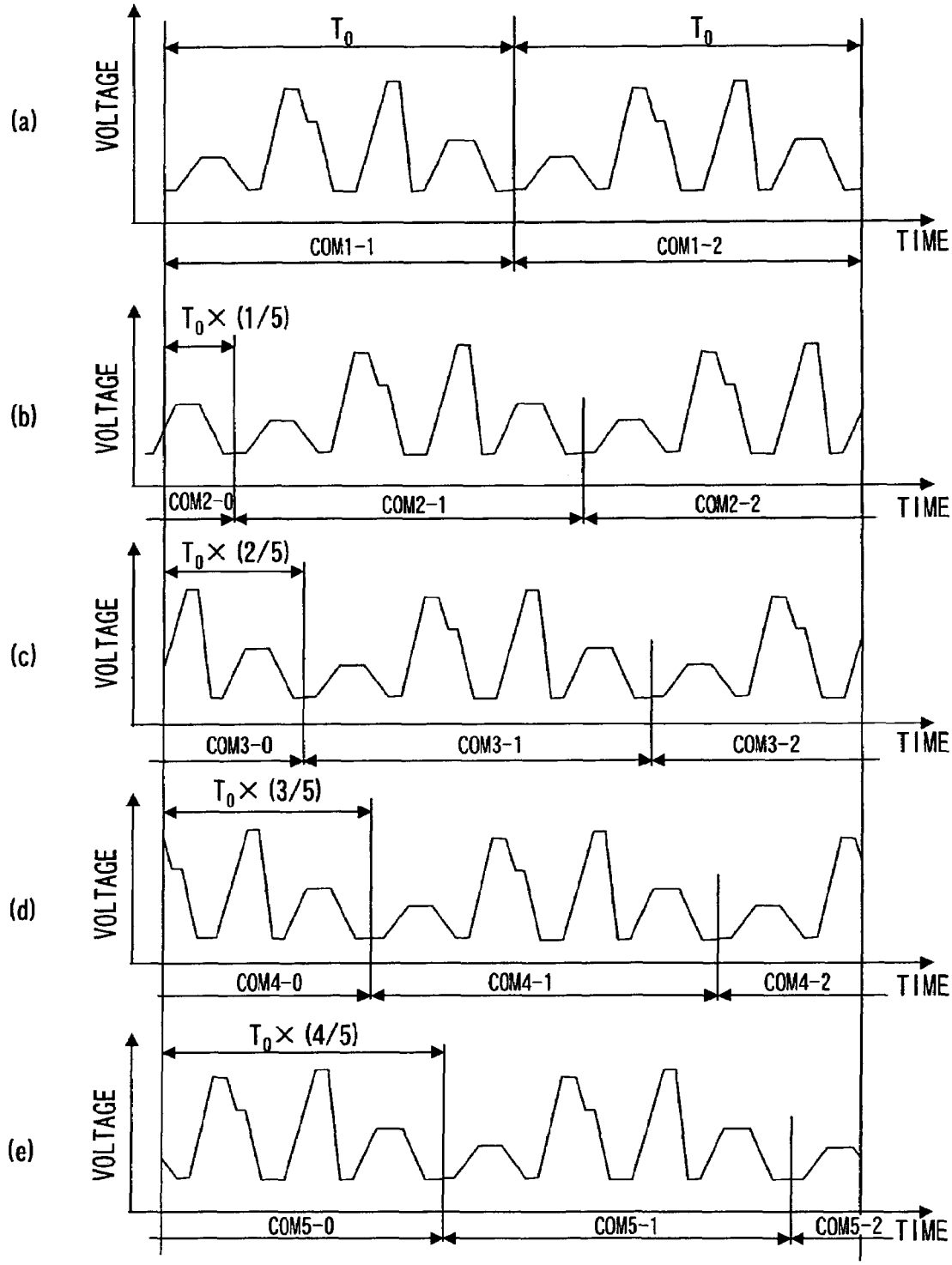
FIG. 12 is a waveform diagram showing embodiments of drive signals applied to actuators.

For example, as shown in (a) of FIG. 12, if the common drive waveform which is earliest in the time sequence is taken as the reference common drive waveform, then desirably, the drive cycles of the other common drive waveforms come within two cycles of the drive waveform cycle T0 of this reference common drive waveform, as shown in FIG. 12. In other words, desirably, the phase of each common drive waveform is adjusted in such a manner that the waveform of one cycle of the other common drive waveforms completely comes within two cycles (2×T0) of the reference common drive waveform.

In the embodiments in FIG. 12, (b) of FIG. 12 shows a case where the phase is staggered by T0×(1/5) with respect to the reference common drive waveform shown in (a) of FIG. 12, (c) of FIG. 12 shows a case where the phase is staggered by T0×(2/5) respect to the reference common drive waveform shown in (a) of FIG. 12, (d) of FIG. 12 shows a case where the phase is staggered by T0×(3/5) respect to the reference common drive waveform shown in (a) of FIG. 12, and (e) of FIG. 12 shows a case where the phase is staggered by T0×(4/5) respect to the reference common drive waveform shown in (a) of FIG. 12.

In the present embodiment, the common drive waveforms shown in FIG. 12 are generated respectively by the drive circuits (130A to 130E) shown in FIG. 9, and they are input respectively to the ports "COM1" to "COM5" of the switch IC 120.

Next, an embodiment of a control sequence in the inkjet recording apparatus 10 having the foregoing composition is described. This control sequence is carried out chiefly during the adjustment between apparatuses in the inspection for shipment from the factory; however, it may also be carried out during initial settings after turning on the power supply during normal use, during a period of inactivity, or during an adjustment operation.

Figure 13:
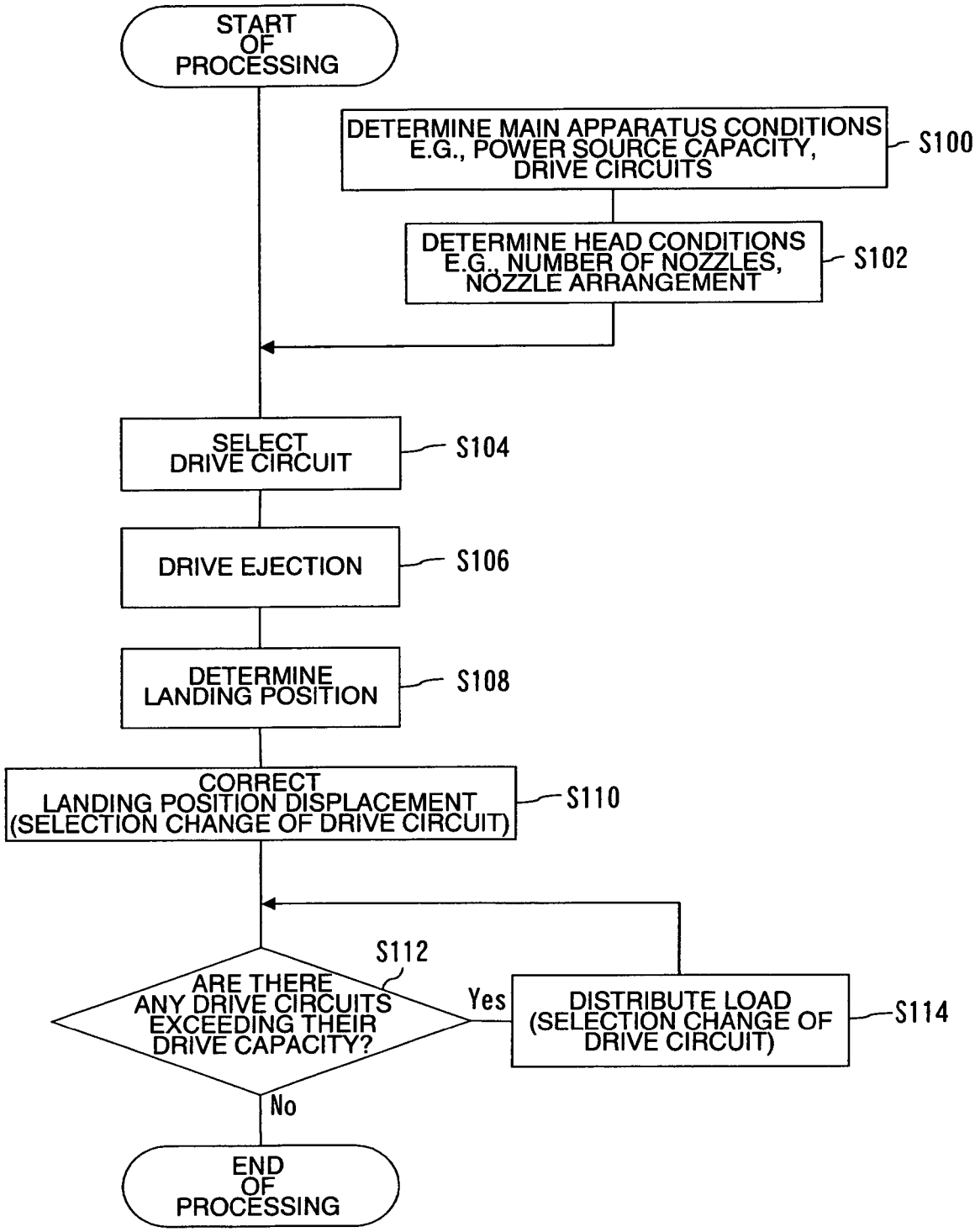
FIG. 13 is a flowchart showing a first control embodiment.

FIG. 13 is a flowchart showing a first control example of the present embodiment. A simplified representation of the nozzle row 151B shown in FIG. 5 is depicted in the upper part of FIG. 14 and FIG. 15, and below the simplified nozzle row 151B, a row of dots formed by the nozzle row 151B is depicted. Each of the numbers indicated inside the dots represents the drive circuit selected by the corresponding actuator 58 when a droplet is ejected to form that dot: "1" denotes that the drive circuit 130A is selected, "2" denotes that the drive circuit 130B is selected, "3" denotes that the drive circuit 130C is selected, "4" denotes that the drive circuit 130D is selected and "5" denotes that the drive circuit 130E is selected. Below, the flowchart shown in FIG. 13 is described with reference to the embodiments shown in FIG. 14 and FIG. 15.

In FIG. 13, when processing starts, the conditions of the main apparatus are determined (or acquired) (step S100), information on the power source capacity and the number of drive circuits (five in the embodiment in FIG. 9), and the like, is acquired, and the head conditions are determined (step S102), and information on the number of nozzles and the nozzle arrangement, and the like, is obtained. The information on the main apparatus is stored in a storage device, such as an EEPROM, or the like, and the information is read out as and when required.

On the basis of the information thus acquired, with respect to each actuator 58, a drive circuit used for driving an actuator 58 is selected from the plurality of drive circuits 130A to 130E in such a manner that the dot row formed by the nozzle row 151B is aligned in a linear fashion in the main scanning direction (step S104). After that, by driving each actuator 58, ink is ejected from the corresponding nozzles 51 (step S106).

Figure 14:
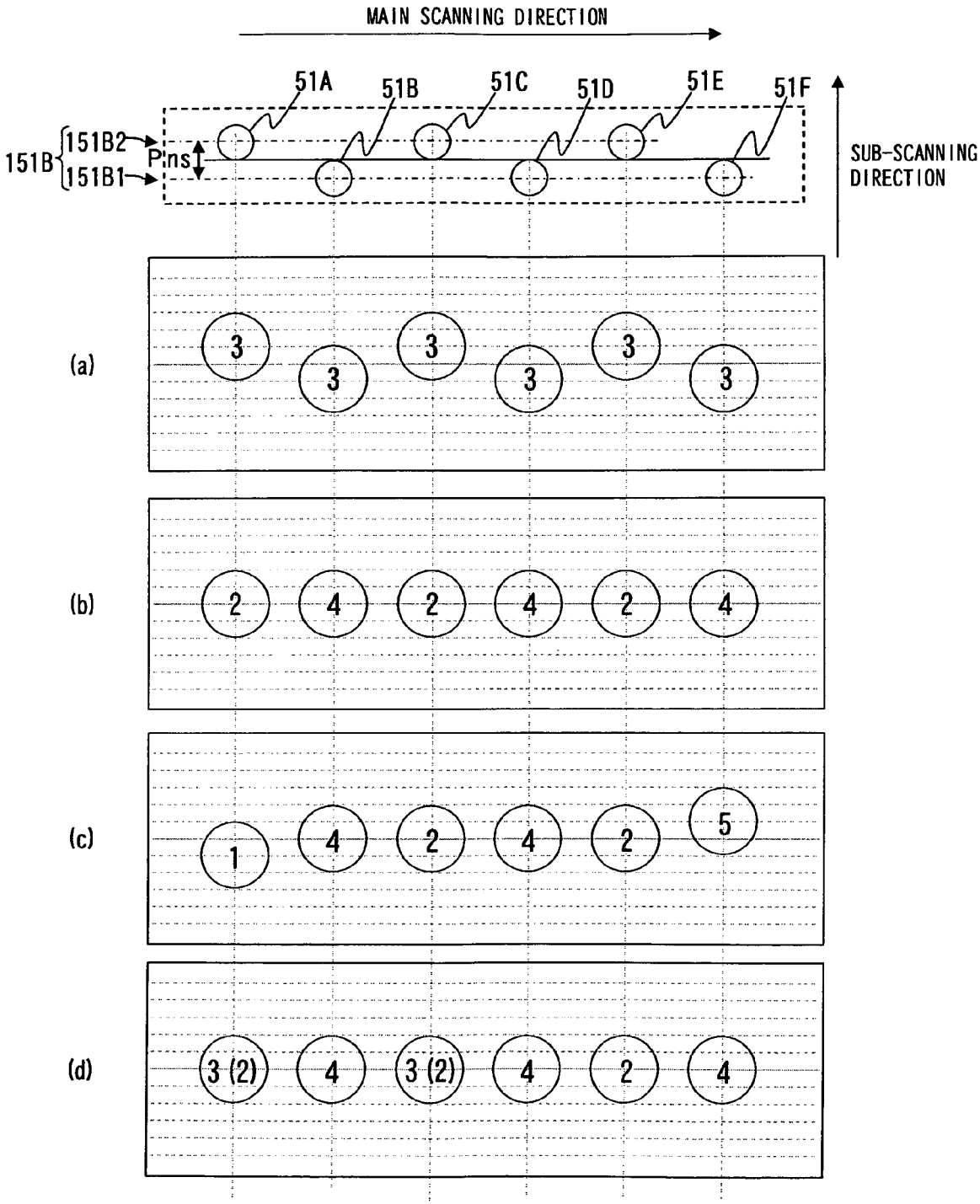
FIG. 14 is an illustrative diagram of the first control embodiment.

FIG. 14 shows a case where the nozzle row 151B does not include nozzles suffering deposition position displacement, and (a) of FIG. 14 shows, as a reference for the purpose of comparison, the state of a row of dots formed when the same drive circuit 130C is selected for all of the actuators 58 corresponding to the nozzle row 151B. In the head 50 according to the present embodiment, in consideration of the momentary power consumption, the same drive circuit is not selected as shown in (a) of FIG. 14 in such a manner that the actuators 58 are driven at the same time on the basis of drive waveforms having the same phase, but rather, when processing for selecting the drive circuits is carried out in step S104 in FIG. 13, the drive circuits 130B and 130D are selected alternately for the actuators 58 corresponding to the nozzle row 151B as shown in (b) of FIG. 14, in such a manner that a dot row is formed linearly in the main scanning direction. In other words, in order to form a dot row in a linear fashion in the main scanning direction, a plurality of drive circuits are selected, and thus the momentary current consumption and the momentary power consumption of each of the drive circuits are reduced.

Figure 15:
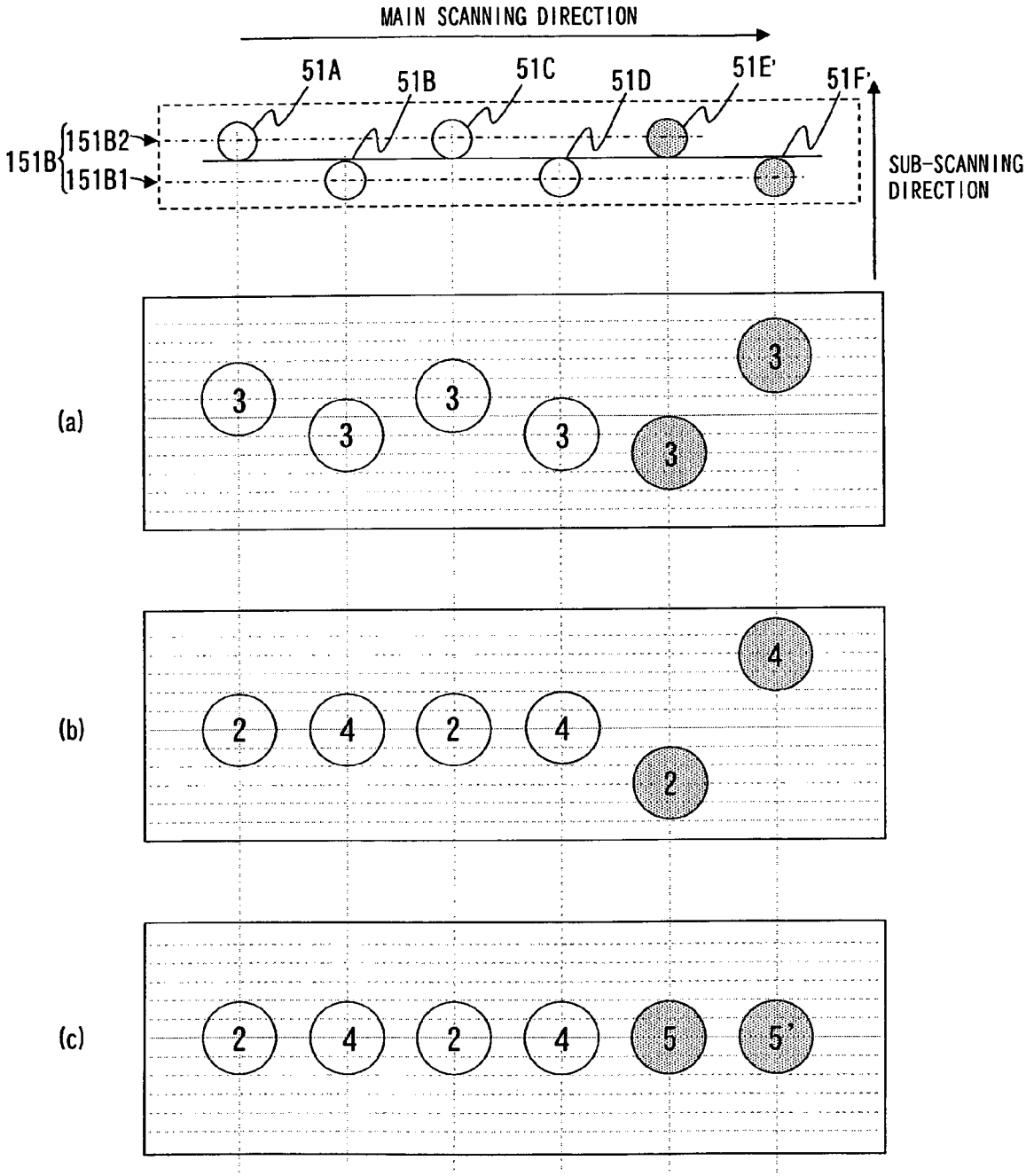
FIG. 15 is an illustrative diagram of the first control embodiment.

FIG. 15 shows a case where the nozzle row 151B does include nozzles suffering deposition position displacement, namely, nozzles 51E' and 51F'. Item (a) of FIG. 15 shows, as a reference for the purpose of comparison, the state of a row of dots formed when the same drive circuit 130C is selected for all of the actuators 58 corresponding to the nozzle row 151B. As stated previously, in the head 50 according to the present embodiment, due to considerations of the momentary power consumption, the same drive circuit is not selected as shown in (a) of FIG. 15 so that the actuators 58 are not driven at the same time by drive waveforms having the same phase. If there are nozzles suffering deposition position displacement, then when processing for selecting a drive circuit is carried out at step S104 in FIG. 13, the dots formed by droplets ejected by the nozzles 51E' and 51F' suffering deposition position displacement are formed respectively at positions displaced by a prescribed amount in the sub-scanning direction as shown in (b) of FIG. 15. In other words, the dot row formed by the nozzle row 151B is not arranged linearly following the main scanning direction, simply on the basis of the various conditions obtained at step S100 and step S102.

Therefore, in the present control embodiment, the deposition positions of the dots formed at step S106 are determined, and their amount of displacement from the prescribed deposition positions, in the sub-scanning direction, is calculated (step S108). The deposition positions are determined by the print determination unit 24 shown in FIGS. 1 and 7. Thereupon, correction of the deposition position displacement is carried out (step S110). More specifically, in accordance with the amount of displacement of the deposition position, a drive circuit selected for the corresponding actuator 58 is changed to another drive circuit. In the dot row formed after changing the selection of the drive circuits, the deposition positions are corrected and the dots are arranged in a linear fashion following the main scanning direction, as shown in (c) FIG. 15.

In the dot row shown in (c) of FIG. 15, the numeral "5" inside the dot at the right-hand end indicates that the drive circuit 130E is selected for the corresponding actuator 58; this means that the actuator 58 is driven by the common drive waveform that is one position ahead in the time sequence, compared to the dot on the left-hand side thereof (for which the same drive circuit 130E is selected). In other words, whereas the second dot from the right in (c) of FIG. 15 is formed by means of the common drive waveform of COM 5-1 shown (e) of FIG. 12, the right-hand end dot in (c) of FIG. 15 is formed by means of the common drive waveform of COM 5-0 in (e) of FIG. 12. In this way, by altering the timing of the common drive waveform that is applied, and by changing the drive circuit selected for the actuator 58, it is possible to correct variations in the deposition positions, over a wide range.

Next, it is determined whether the momentary current consumption of the drive circuit exceeds a prescribed tolerable value or not, in other words, it is determined whether there is a drive circuit which operates beyond its drive capacity or not (step S112). If it is determined that there is a drive circuit operating beyond its drive capacity (in other words, YES at step S112), then adjustment is carried out in such a manner that a portion of the actuators 58 selecting that drive circuit select another drive circuit(s) (step S114). In other words, if the selection for the actuators 58 is concentrated in a particular drive circuit, and that drive circuit is suffering an excessive load, then adjustment is performed in such a manner that a portion of the actuators 58 are allocated to another drive circuit(s). In this way, the load distribution is achieved. The portion of the actuators 58 may select a plurality of destination drive circuits. Moreover, a spare drive circuit (for example, spare drive waveform generating circuit 130F shown in FIG. 9) may be prepared, separately from the normally used drive circuits, in such a manner that the portion of the actuators 58 can select this spare drive circuit. Furthermore, in control terms, it is desirable that the load of a drive circuit (a drive circuit before the change) which each actuator originally selects is substantially equal to the load of a drive circuit (a drive circuit after the change) which each actuator newly selects. Moreover, from the viewpoint of image quality, it is desirable that the phase difference between the common drive waveform generated by a drive circuit (a drive circuit before the change) which each actuator originally selects and the common drive waveform generated by a drive circuit (a drive circuit after the change) which each actuator newly selects is small.

Furthermore, when distribution of the load to the drive circuits is carried out, it is desirable to give priority to actuators 58 corresponding to the nozzles 51 at the side end sections of the head, which eject droplets to form dots that do not have high visibility (which are not conspicuous) when the image is observed, and to perform the change to another dive circuit with respect to each of the prioritized actuators. For example, if both of the drive circuits 130B and 130D selected in (b) of FIG. 14 operate beyond their respective drive capacities, then desirably, the selection of drive circuit is changed in such a manner that the actuators 58 corresponding to the nozzles 51A and 51F at the end sections of the head selects the drive circuits 130A and 130E respectively, as shown in (c) FIG. 14.

According to the first control embodiment, it is possible to correct variation in the deposition positions, and to reduce the momentary current consumption of each of the drive circuits.

Figure 16:
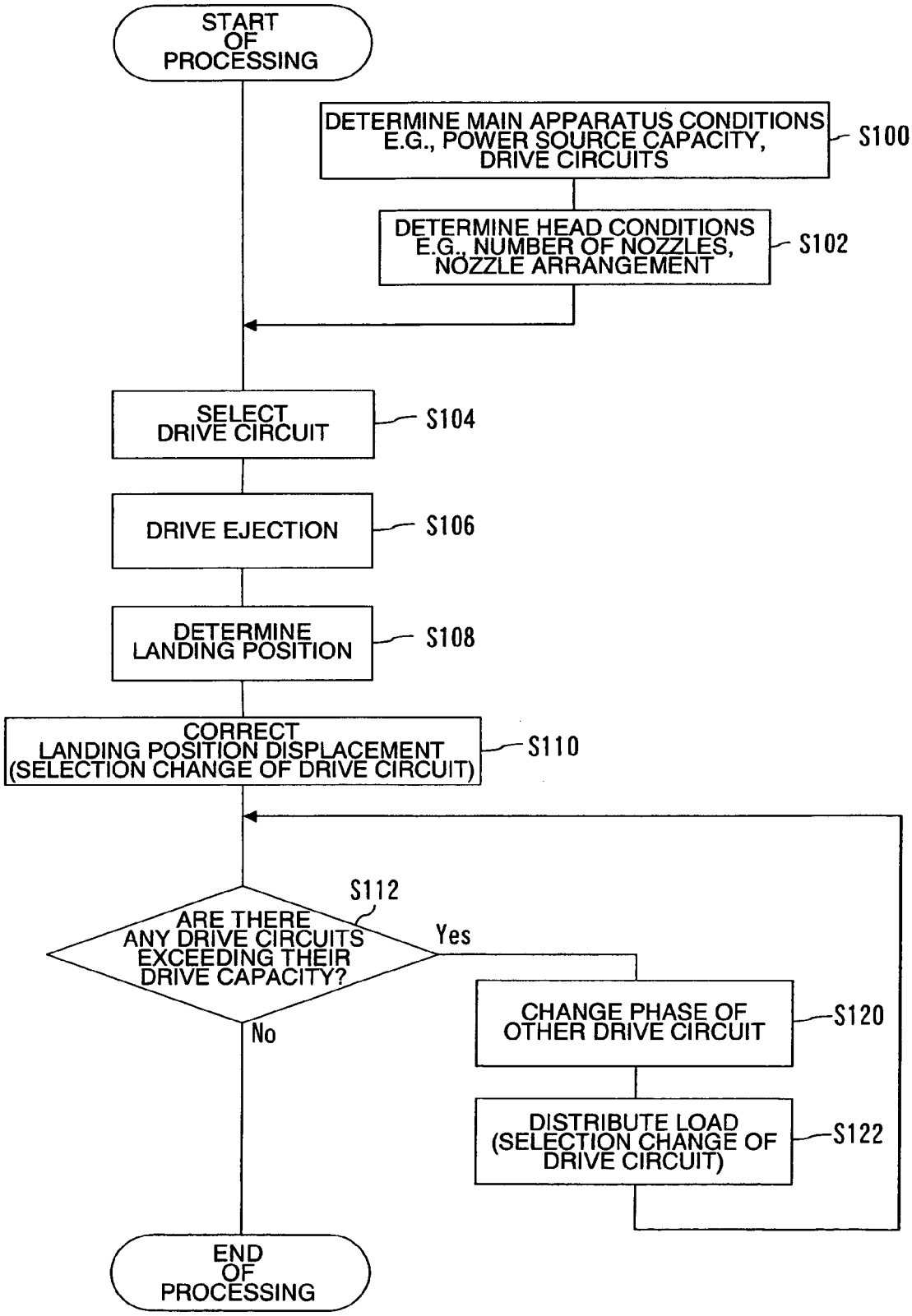
FIG. 16 is a flowchart showing a second control embodiment.

FIG. 16 is a flowchart showing a second control embodiment according to the present embodiment. In FIG. 16, steps which are the same as those in the flowchart in FIG. 13 are labeled with the same step number and description thereof is omitted here.

In the flowchart in FIG. 16, the step S114 in FIG. 13 is replaced with the steps S120 and S122. In other words, in FIG. 16, if it is determined that there is a drive circuit which operates beyond its drive capacity at step S112, then the phase of the common drive waveform generated by the drive circuit which the smallest number of actuators 58 select, of the other drive circuits, is changed (the phase is controlled) in such a manner that it coincides with the common drive waveform generated by the drive circuit which is determined to operate beyond its drive capacity (step S120), and adjustment is performed in such a manner that a portion of the actuators 58 selecting the drive circuit which is determined to operate beyond its drive capacity select the drive circuit having the changed phase (step S122). If the phase change at step S120 is large, then it is also possible that adjustment is performed in such a manner that the actuators 58 selecting the drive circuit which is the object of phase control, select another drive circuit which generates a common drive waveform having a small phase difference.

For example, if the momentary current consumption of the drive circuit 130B corresponding to the number "2" inside the dots exceeds the prescribed tolerable value in the state shown in (b) of FIG. 14, then phase control is implemented in such a manner that the phase of the common drive waveform generated by the drive circuit 130C which the smallest number of actuators 58 select, or the other drive circuits, is made to coincide with the phase of the common drive waveform generated by the drive circuit 130B, and adjustment is performed in such a manner that a portion of the actuators 58 selecting the drive circuit 130B select the drive circuit 130C. Item (d) of FIG. 14 shows the state of a dot row after implementing the control described above. In (d) of FIG. 14, the actuators 58 corresponding to the number "3(2)" inside the dots are actuators 58 which select the drive circuit 130C subjected to the phase control as described above.

In the second control example, when the distribution of the load of the drive circuits is carried out, since there is no phase difference between the common drive waveform generated by a drive circuit (a drive circuit before the change) which each actuator originally selects and the common drive waveform generated by a drive circuit (a drive circuit after the change) which each actuator newly selects, then a row of dots are formed in the desired positions, and hence excellent image quality is achieved.

Figure 17:
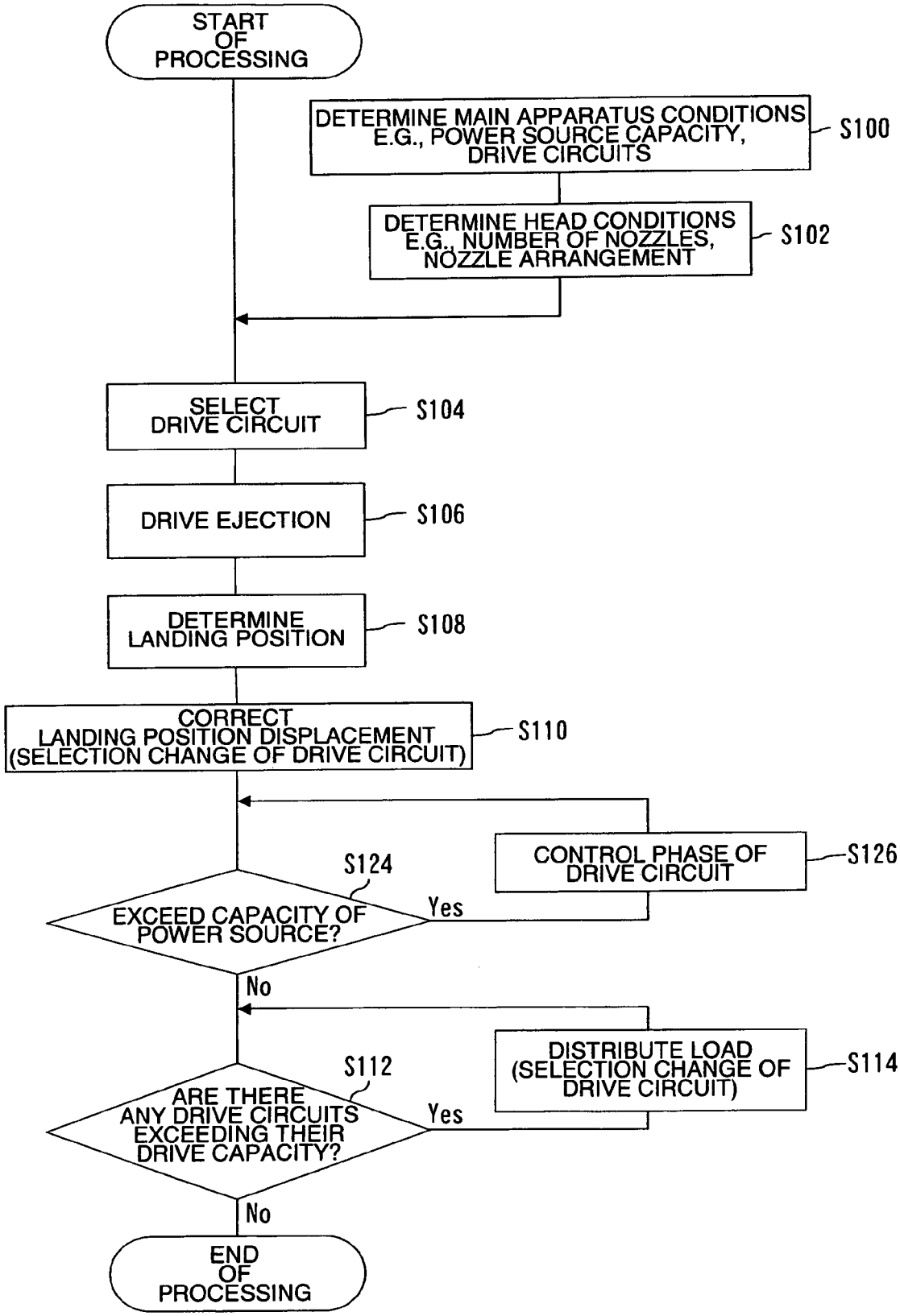
FIG. 17 is a flowchart showing a third control embodiment.

FIG. 17 is a flowchart showing a third control embodiment according to the present embodiment. In FIG. 17, steps which are the same as those in the flowchart in FIG. 13 are labeled with the same step number and description thereof is omitted here.

The flowchart in FIG. 17 comprises additional steps, S124 and S126, between the step S110 and the step S112 in FIG. 13. In other words, in FIG. 17, it is judged whether or not the momentary current consumption of the power source exceeds the capacity of the power source (step S124). If the momentary current consumption of the power source is judged to have exceeded its capacity (in other words, a "Yes" verdict), then the phase(s) of the common drive waveform(s) generated by one drive circuit or by a plurality of drive circuits is changed (the phase(s) is controlled) (step S126), and a judgment process similar to that described above is carried out again at step S124. If, on the other hand, the momentary current consumption of the power source is judged to be within the range of the capacity of the power source (in other words, a "No" verdict), then the procedure advances to the next step, S112, where the processing described previously in relation to FIG. 13 is carried out.

In the third control embodiment, in addition to reducing the momentary current consumption of each of the drive circuits, it is also possible to reduce the momentary current consumption of the system as a whole.

As stated above, according to the present embodiment, by implementing the control described above, variation in the deposition positions can be corrected and the momentary power consumption of the drive circuits can be suppressed, and furthermore, all of the drive circuits can be used in an efficient manner. In this way, the drive capacity estimated in the circuit design can be reduced, and therefore, the scale of the drive circuits can be reduced and cost benefits can also be obtained.

In particular, the following composition is adopted in which the nozzle row 151B in the main scanning direction is divided into a plurality of nozzle rows 151B1 and 151B2 within the range of one pixel, and in which five drive circuits 130A to 130E are provided, in such a manner that phase control is possible in a total of five different phases: two phases corresponding to the row division number (in the present embodiment, 2), and three phases corresponding to the divided rows and the rows either side of same. Therefore, it is possible to correct displacement of the deposition positions effectively and reduce the momentary power consumption, while it is possible to maintain the high-speed printing capability that is characteristic of a line head system.

The number of divisions of the nozzle row 151B is not limited to that of the present embodiment. For example, other desirable modes include one where the number of drive circuits is 7 with respect to a division number of 3 of the nozzle row 151B, and one where the number of drive circuits is 9 with respect to a row division number of 4.

There are no particular restrictions on the control sequence of the flowcharts shown in FIGS. 13, 16 and 17, and a plurality of procedures may be carried out simultaneously. Furthermore, the various types of analysis, judgment and calculation may be carried out by means of a CPU or image processing LSI installed in the inkjet recording apparatus 10, or they may be carried out by the host computer 86, or, of course, the processing may be shared between same.

If the number of drive circuits is increased, then the drive current per drive circuit is reduced, and not only does this increase the range of selection of the transistors used in the power amplifier section, and the like, but it also allows the possibility of using transistors capable of high-speed switching which is an important characteristic in waveform generation. The number of drive circuits can be designed suitably in accordance with various factors, such as the number of actuators, the ejection performance, the circuit size, costs, and the like.

Further Embodiment

Figure 18A:
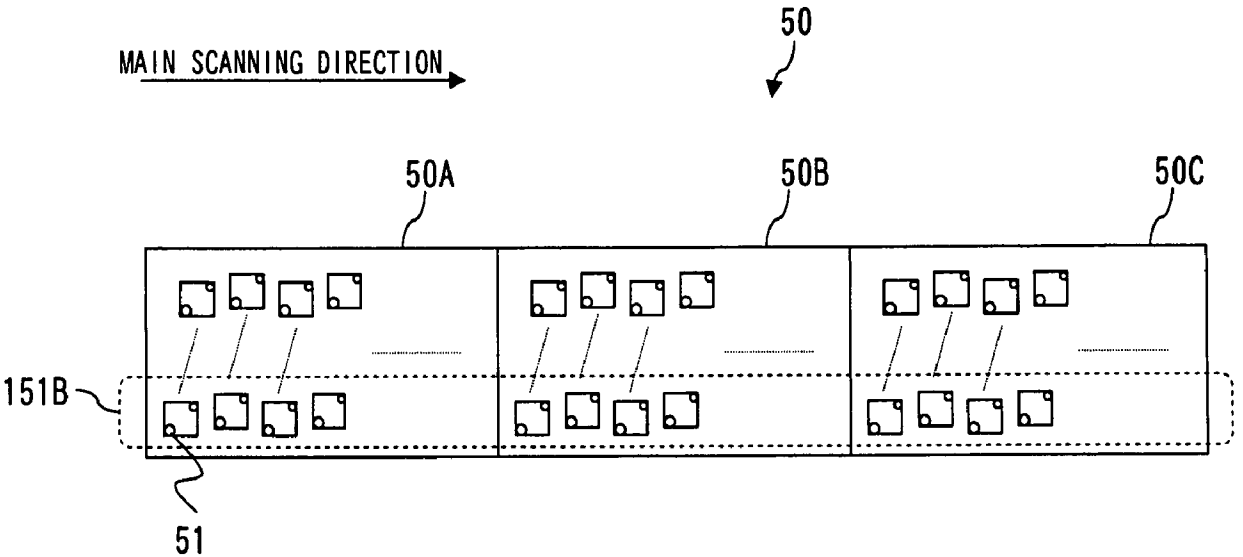
FIGS. 18A and 18B are plan view perspective diagrams showing an embodiment of the structure of a head relating to a further embodiment.
Figure 18B:
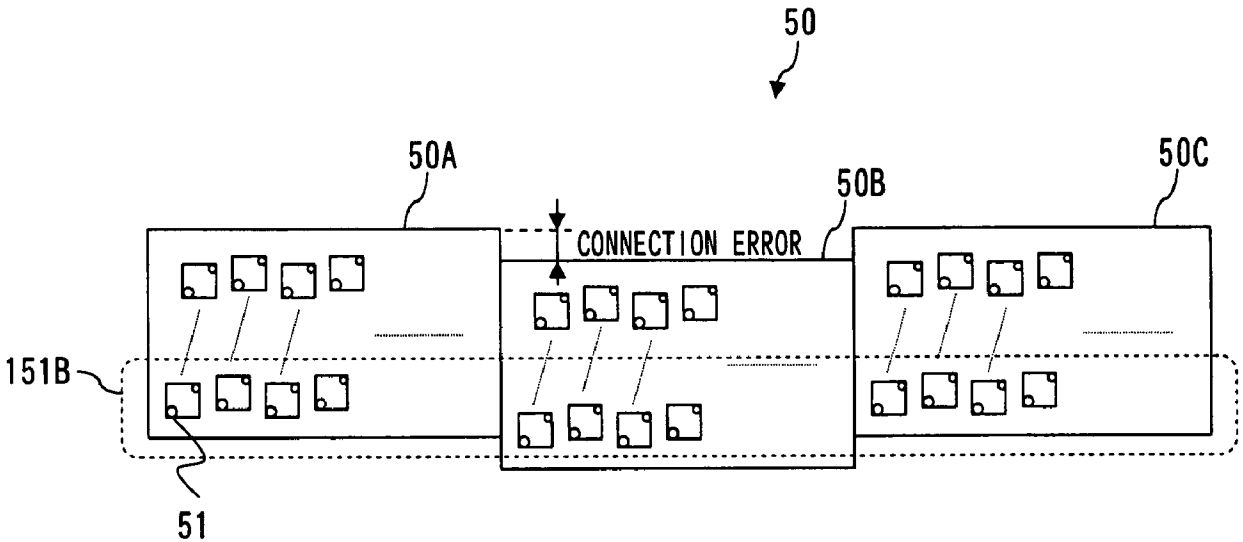

FIGS. 18A and 18B are plan view perspective diagrams showing a head 50 according to a further embodiment of the present invention. The head 50 shown in FIG. 18A is a line head which is formed to a long length by joining together short heads 50A, 50B and 50C, in the main scanning direction. In a line head having a composition of this kind, it is possible to improve the production yield and the processing accuracy of the nozzles, and the like. However, in a case where short heads are connected together at divergent positions in the sub-scanning direction, as shown in FIG. 18B, there is a problem of variation in the deposition positions caused by the connection error between the short heads. In view of this point, according to the present invention, it is possible to correct not only the variation in the deposition positions within each short head, but also the variation in the deposition positions caused by connection error between the short heads.

Figure 19:
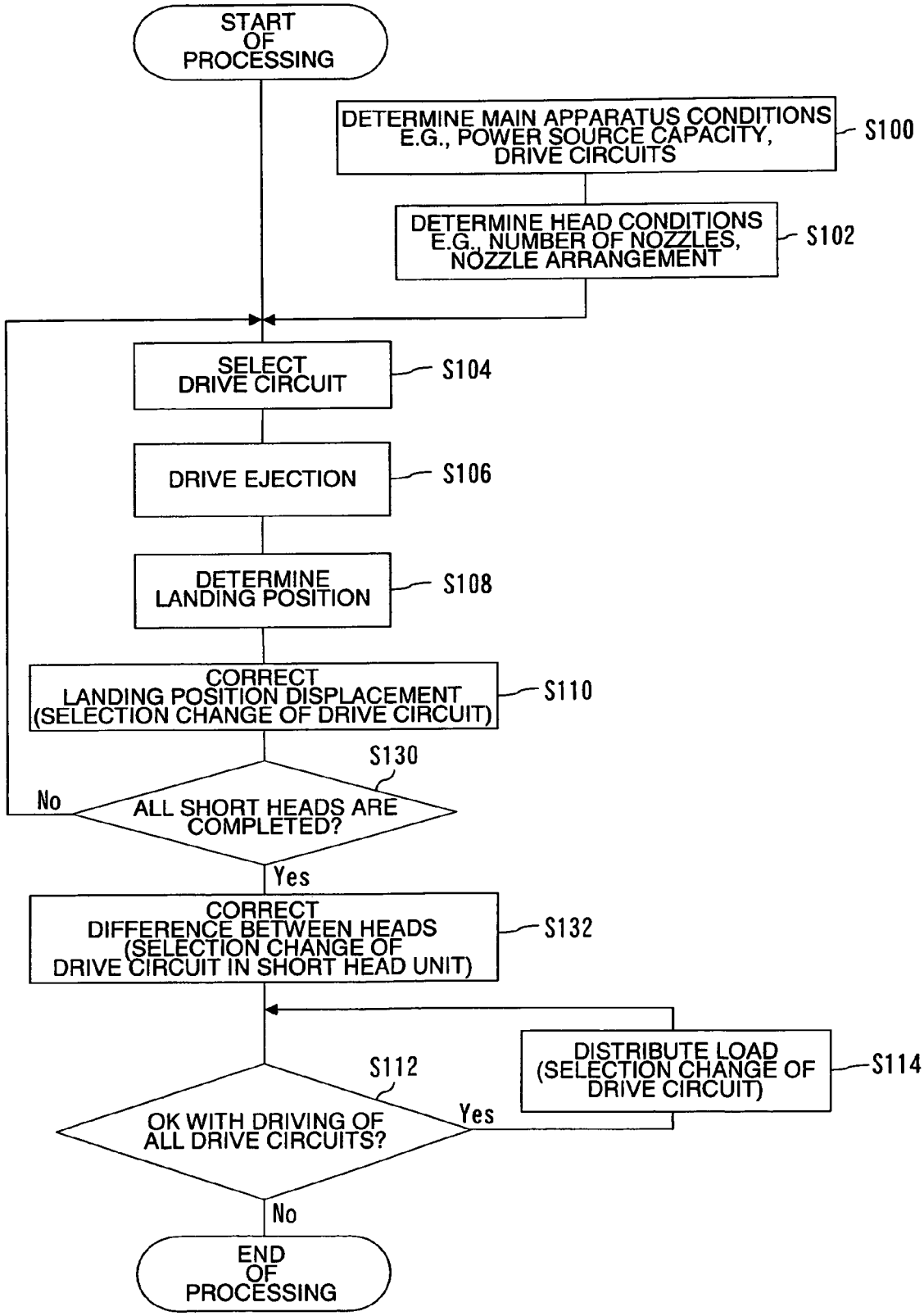
FIG. 19 is a flowchart showing a control embodiment relating to the further embodiment.
Figure 20:
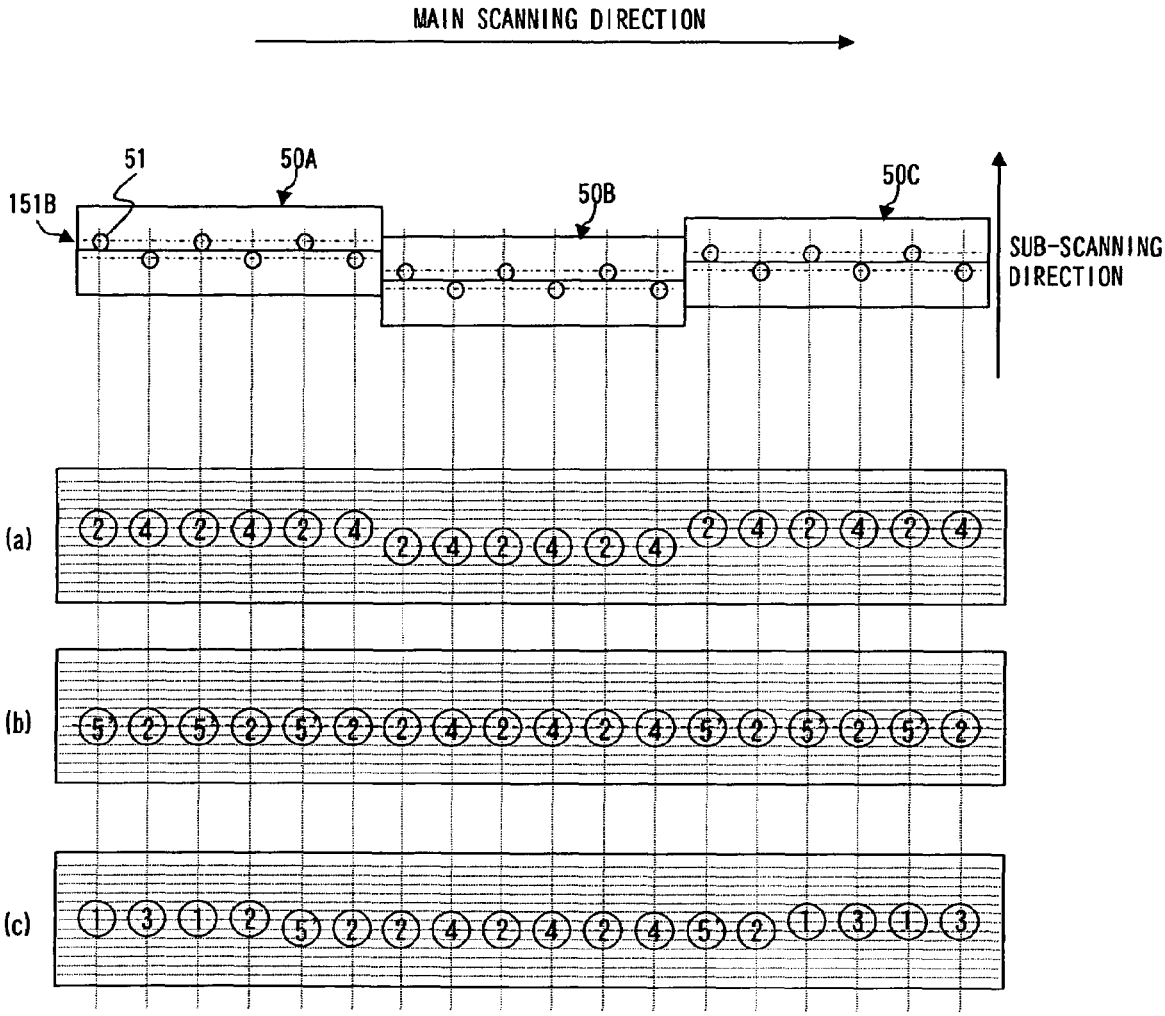
FIG. 20 is an illustrative diagram of a control embodiment relating to the further embodiment.

FIG. 19 is a flowchart showing a control example of the further embodiment. A simplified representation of the nozzle row 151B shown in FIG. 18B is depicted in the upper part of FIG. 20, and below this, a row of dots formed by the nozzle row 151B is depicted. Below, the flowchart shown in FIG. 19 is described with reference to the embodiments shown in FIG. 20. In FIG. 19, steps which are the same as those in the flowchart in FIG. 13 are labeled with the same step number and description thereof is omitted here.

The flowchart shown in FIG. 19 comprises the additional steps of S130 and S132, in addition to the steps shown in the flowchart in FIG. 13. In other words, in FIG. 19, it is judged whether or not the processing for all of the short heads has been completed (step S130), and if it is judged that there is an unprocessed short head (in other words, a "No" verdict), then the procedure returns to step S104. If, on the other hand, it is judged that processing has been completed for all of the short heads (in other words, a "Yes" verdict), then the procedure advances to the next step, S132. In other words, the variation in the deposition positions is corrected for each short head. Thereby, as shown in (a) of FIG. 20, the dot rows formed by the short heads 50A, 50B and 50C are respectively arranged in a linear fashion following the main scanning direction. However, at this stage, the dot rows are formed at displaced positions in the sub-scanning direction, due to connection errors between the short heads, and hence the overall dot row is not arranged linearly following the main scanning direction.

In the next step, S132, the amount of displacement between the short heads is calculated, and the selection of the drive circuit is changed, in short head units, in such a manner that the displacement in the sub-scanning direction between the dot rows is corrected. Consequently, as shown in (b) of FIG. 20, the dot rows formed by the short heads 50A, 50B and 50C assume a state in which the whole dot row corresponding to the plurality of short heads, and not just each individual short head, is arranged in a linear fashion in the main scanning direction. In this way, it is possible to correct the displacement in the sub-scanning direction of the dot rows (in other words, variation in the deposition positions), due to connection errors between short heads.

Thereupon, it is judged whether or not each of the drive circuits can be driven (step S112), and if there is a drive circuit which operates beyond its drive capacity (in other words, a "No" verdict), then adjustment is performed in such a manner that a portion of the actuators 58 for which that drive circuit is selected select another drive circuit (or a spare drive circuit), thereby distributing the load on the drive circuits. When the selection of the drive circuits is changed, desirably, the actuators 58 of the short heads at the side end sections of the liquid ejection head, rather than those in the central section, are prioritized and are changed to select another drive circuit. Furthermore, desirably, within each of the short heads at the side end sections, the actuators 58 corresponding to the nozzles 51 in the end section opposite to the side that is connected to another short head (in other words, the side at the end of the line head) are prioritized and are changed to select another drive circuit. If further change of the drive circuit selection is required, then desirably, the actuators 58 corresponding to the nozzles 51 in the central portions of the short heads at the side end sections are changed so as to select other drive circuits. In this way, it is possible to reduce the visibility of non-uniformities caused by displacement between the short heads. For example, in the case shown in (b) of FIG. 20, if both the drive circuit 130B corresponding to the number "2" inside the dots and the drive circuit 130E corresponding to the number "5" inside the dots operate beyond their drive capacities, then as shown in (c) of FIG. 20, desirably, the actuators 58 corresponding to the nozzles 51 in the end sections corresponding to the ends of the line head, of the short heads 50A and 50C in the side end sections of the line head are changed so as to select the drive circuits 130A and 130C, and furthermore the actuators 58 corresponding to the nozzles 51 in the central portions of the short heads 50A and 50C are changed so as to select the drive circuits 130A and 130C. The method of changing the drive circuit selected for an actuator 58 is similar to that of the embodiments described above.

In the present embodiment, by implementing control in accordance with the flowchart shown in FIG. 19, it is possible to correct not only variation in the deposition positions in each short head, but also variation in the deposition positions caused by connection errors between the short heads. Furthermore, if there is a drive circuit that operates beyond its drive capacity, then it is possible to reduce the momentary power consumption and minimize the variation in the deposition positions.

Moreover, in the foregoing explanation, an inkjet recording apparatus is described as one embodiment of an image forming apparatus; however, the scope of application of the present invention is not limited to this. For example, the drive apparatus of a liquid ejection head and the liquid ejection apparatus according to the present invention may also be applied to a photographic image forming apparatus in which developing solution is applied to a printing paper by means of a non-contact method. Furthermore, the scope of application of the driving apparatus of a liquid ejection head and the liquid ejection apparatus according to the present invention is not limited to an image forming apparatus, and the present invention may also be applied to various other types of apparatuses (such as a coating device, wiring pattern printing device, or the like) which spray a treatment liquid, or other liquid, toward an ejection receiving medium by means of a liquid ejection head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid ejection head including a plurality of nozzles arranged in a prescribed pattern in a first direction and a plurality of pressure generating elements provided to correspond with the plurality of nozzles respectively, wherein liquid is ejected toward a recording medium from the nozzles by supplying drive signals to the pressure generating elements;

a plurality of drive waveform generating circuits which generate drive signal waveforms for driving the pressure generating elements;

a circuit selection device which selectively switches the drive waveform generating circuits for applying the drive signal waveforms to the pressure generating elements, of the plurality of drive waveform generating circuits;

a power source which supplies power to the pressure generating elements via the drive waveform generating circuits;

a control device which selects a first drive waveform generating circuit used for driving each of the pressure generating elements, with respect to each of the pressure generating elements, of the plurality of drive waveform generating circuits, in such a manner that the liquid ejected from the nozzles is deposited substantially linearly in the first direction on the recording medium, and controls the circuit selection device in such a manner that the first drive waveform generating circuit is connected to each of the pressure generating elements; and a monitoring device which monitors whether an amount of momentary current consumption in each of the plurality of drive waveform generating circuits exceeds a prescribed tolerable level that is prescribed for each of the plurality of drive waveform generating circuits, wherein the control device selects a second drive waveform generating circuit which is different from the first drive waveform generating circuit, instead of the first drive waveform generating circuit, of the plurality of drive waveform generating circuits, in respect of at least a portion of the pressure generating elements, in such a manner that no drive waveform generating circuit in which the amount of momentary current consumption exceeds the prescribed tolerable value, of the plurality of drive waveform generating circuits, exists.

2. The image forming apparatus as defined in claim 1, wherein, of the drive signal waveforms generated by the drive waveform generating circuits, the drive signal waveform generated by the second drive waveform generating circuit has less phase difference with respect to the drive signal waveform generated by the first drive waveform generating circuit.

3. The image forming apparatus as defined in claim 1, wherein the plurality of nozzles include a first nozzle and a second nozzle which have an offset in a second direction perpendicular to the first direction, the offset being smaller than a dot pitch in the second direction between dots formed by the liquid ejected from the nozzles.

4. The image forming apparatus as defined in claim 1, wherein the control device selects the second drive waveform generating circuit, giving priority to the pressure generating element which corresponds to the nozzle in a side end section of the liquid ejection head, rather than the nozzle in a central portion of the liquid ejection head, of the plurality of pressure generating elements.

5. The image forming apparatus as defined in claim 1, wherein a phase of the drive signal waveform generated by the first drive waveform generating circuit coincides with a phase of the drive signal waveform generated by the second drive waveform generating circuit.

6. The image forming apparatus as defined in claim 1, further comprising a spare drive waveform generating circuit, wherein the control device selects the spare drive waveform generating circuit in a case where the amount of momentary current consumption of the first drive waveform generating circuit exceeds the prescribed tolerable value.

7. The image forming apparatus as defined in claim 1, wherein the control device controls a phase of the drive signal waveform generated by at least one of the plurality of drive waveform generating circuits, in such a manner that an amount of momentary current consumption of the power source is not more than a prescribed upper limit value.

8. The image forming apparatus as defined in claim 1, wherein the plurality of nozzles form a plurality of nozzle rows which are each arranged in an oblique direction which is not perpendicular to the first direction.

9. The image forming apparatus as defined in claim 1, wherein, the liquid ejection head includes a plurality of short heads arranged in the first direction; and the control device controls the circuit selection device, in such a manner that the liquid ejected from the nozzles in each of the short heads is deposited substantially linearly in the first direction on the recording medium and the liquid ejected from the nozzles in the short heads adjacent to each other is deposited substantially linearly in the first direction on the recording medium.

10. The image forming apparatus as defined in claim 1, wherein, the liquid ejection head includes a plurality of short heads arranged in the first direction; and the control device controls the circuit selection device in such a manner that the liquid ejected from the nozzles in each of the short heads is deposited substantially linearly in the first direction on the recording medium and the liquid ejected from the nozzles in the short heads adjacent to each other is deposited substantially linearly in the first direction on the recording medium, and selects the second drive waveform generating circuit, giving priority to the pressure generating elements in the short head arranged in a side end section of the short heads, in such a manner that an amount of momentary current consumption of the first drive waveform generating circuit does not exceed a prescribed tolerable value.

11. The image forming apparatus as defined in claim 10, wherein the control device selects the second drive waveform generating circuit, giving priority to the pressure generating element which corresponds to the nozzle that is distant from an end section of the short head arranged in the side end section where another short head of the short heads is disposed, of the nozzles of the short head arranged in the side end section.

12. An image forming apparatus, comprising:

a liquid ejection head including a plurality of nozzles arranged in a prescribed pattern in a first direction and a plurality of pressure generating elements provided to correspond with the plurality of nozzles respectively, wherein liquid is ejected toward a recording medium from the nozzles by supplying drive signals to the pressure generating element;

a plurality of drive waveform generating circuits which generate drive signal waveforms for driving the pressure generating elements;

a circuit selection device which selectively switches the drive waveform generating circuits for applying the drive signal waveforms to the pressure generating elements, of the plurality of drive waveform generating circuits;

a power source which supplies power to the pressure generating elements via the drive waveform generating circuits;

a control device which selects a first drive waveform generating circuit used for driving each of the pressure generating elements, with respect to each of the pressure generating elements, of the plurality of drive waveform generating circuits, in such a manner that the liquid ejected from the nozzles is deposited substantially linearly in the first direction on the recording medium, and controls the circuit selection device in such a manner that the first drive waveform generating circuit is connected to each of the pressure generating elements; and a spare drive waveform generating circuit, wherein the control device selects the spare drive waveform generating circuit in a case where an amount of momentary current consumption of the first drive waveform generating circuit exceeds a prescribed tolerable value.

* * * * *